US009715791B2

(12) United States Patent
LaDuca

(10) Patent No.: US 9,715,791 B2
(45) Date of Patent: Jul. 25, 2017

(54) METHODS FOR ADMINISTERING A DOUBLE DRAW POKER CASINO CARD GAME

(71) Applicant: AGS, LLC, Las Vegas, NV (US)

(72) Inventor: Ronald LaDuca, Ledyard, CT (US)

(73) Assignee: AGS, LLC, Las Vegas, NV (US)

( * ) Notice: Subject to any disclaimer, the term of this patent is extended or adjusted under 35 U.S.C. 154(b) by 26 days.

(21) Appl. No.: 14/191,213

(22) Filed: Feb. 26, 2014

(65) Prior Publication Data

US 2014/0179391 A1 Jun. 26, 2014

Related U.S. Application Data

(63) Continuation-in-part of application No. 13/779,547, filed on Feb. 27, 2013.

(60) Provisional application No. 61/744,339, filed on Sep. 24, 2012.

(51) Int. Cl.

| | |
|---|---|
| ***A63F 3/00*** | (2006.01) |
| ***G07F 17/32*** | (2006.01) |
| ***A63F 1/00*** | (2006.01) |

(52) U.S. Cl.

CPC ..... *G07F 17/3293* (2013.01); *A63F 1/00* (2013.01); *A63F 3/00157* (2013.01); *G07F 17/3244* (2013.01)

(58) Field of Classification Search

CPC ..... A63F 3/08; A63F 3/24; A63F 2003/00164
See application file for complete search history.

(56) References Cited

U.S. PATENT DOCUMENTS

| | | | | |
|---|---|---|---|---|
| 4,743,022 | A | 5/1988 | Wood | |
| 4,926,327 | A | 5/1990 | Sidley | |
| 6,102,402 | A | 8/2000 | Scott et al. | |
| 6,315,664 | B1 | 11/2001 | Baerlocher et al. | |
| 6,402,147 | B1 * | 6/2002 | Lo | 273/292 |
| 6,416,407 | B1 | 7/2002 | Carrico et al. | |
| 6,540,230 | B1 | 4/2003 | Walker et al. | |
| 6,581,936 | B1 | 6/2003 | Zoccolillo et al. | |

(Continued)

OTHER PUBLICATIONS

"Variations of 5 Card Draw Poker—5 Card Draw Poker Info," 5carddrawpoker.net, http://www.5carddrawpoker.net/variations-of--5-card-draw-poker.php, (Feb. 4, 2012), 2 pages.

(Continued)

*Primary Examiner* — James S McClellan
*Assistant Examiner* — Kevin Carter
(74) *Attorney, Agent, or Firm* — Weide & Miller, Ltd.

(57) ABSTRACT

A method for playing a double draw poker casino card game comprises providing a standard fifty-two card deck of playing cards and two joker cards shuffled together with the standard fifty-two card deck. Each of the two joker cards is valued as an ace, as a fill-in card for a straight, or as a fill-in card for a flush. Each player places an ante bet and a bonus bet and receives five dealt cards. Each player folds or makes a first optional draw card bet and discards and draws up to three draw cards. Each player folds or makes a second optional draw card bet and discards and draws up to one draw card, producing a final double draw five card poker hand that receives a payout against a first payout table, for the ante bet and draw bets, and against a second payout table for the bonus bet.

7 Claims, 16 Drawing Sheets

(56) References Cited

U.S. PATENT DOCUMENTS

| | | | | |
|---|---|---|---|---|
| 6,679,497 | B2 | 1/2004 | Walker et al. | |
| 6,755,741 | B1 | 6/2004 | Rafaeli | |
| 6,783,457 | B2 | 8/2004 | Hughs-Baird et al. | |
| 6,827,348 | B1 | 12/2004 | Mitchell | |
| 6,991,538 | B2 | 1/2006 | Cannon | |
| 7,121,550 | B1 * | 10/2006 | Lo | 273/292 |
| 7,137,628 | B2 | 11/2006 | Moody | |
| 7,156,397 | B2 | 1/2007 | Moody et al. | |
| 7,311,597 | B2 | 12/2007 | Thomas | |
| 7,661,676 | B2 | 2/2010 | Smith et al. | |
| 7,704,136 | B2 | 4/2010 | Shackleford et al. | |
| 7,766,332 | B2 | 8/2010 | Grauzer et al. | |
| 7,803,043 | B2 | 9/2010 | Jackson | |
| 7,850,522 | B2 | 12/2010 | Walker et al. | |
| 7,901,285 | B2 | 3/2011 | Tran et al. | |
| 7,993,191 | B2 | 8/2011 | Evans et al. | |
| 8,070,574 | B2 | 12/2011 | Grauzer et al. | |
| 8,142,283 | B2 | 3/2012 | Lutnick et al. | |
| 8,177,619 | B2 | 5/2012 | Jackson | |
| 8,187,071 | B1 | 5/2012 | Shackleford et al. | |
| 8,202,150 | B2 | 6/2012 | Berman et al. | |
| 8,210,532 | B2 | 7/2012 | Evans et al. | |
| 8,210,533 | B2 | 7/2012 | Evans et al. | |
| 8,262,475 | B2 | 9/2012 | Snow et al. | |
| 8,272,958 | B2 | 9/2012 | Smith et al. | |
| 8,323,085 | B2 | 12/2012 | Berman et al. | |
| 8,480,471 | B2 | 7/2013 | Lutnick et al. | |
| 2002/0190469 | A1 | 12/2002 | Conklin et al. | |
| 2003/0040352 | A1 * | 2/2003 | Marks | G07F 17/3293 463/13 |
| 2003/0104851 | A1 | 6/2003 | Merari | |
| 2004/0075215 | A1 * | 4/2004 | Snow et al. | 273/292 |
| 2004/0100025 | A1 | 5/2004 | Conklin et al. | |
| 2004/0160008 | A1 * | 8/2004 | Sawyer | 273/292 |
| 2005/0001378 | A1 | 1/2005 | Lo | |
| 2005/0059451 | A1 * | 3/2005 | Shackleford | 463/13 |
| 2005/0164759 | A1 | 7/2005 | Smith et al. | |
| 2005/0261056 | A1 * | 11/2005 | Smolucha | 463/25 |
| 2006/0194629 | A1 | 8/2006 | Strom | |
| 2007/0228656 | A1 | 10/2007 | Jackson | |
| 2010/0038849 | A1 | 2/2010 | Scheper et al. | |
| 2010/0222122 | A1 * | 9/2010 | Vang et al. | 463/11 |
| 2010/0289220 | A1 | 11/2010 | Jackson | |
| 2011/0115160 | A1 | 5/2011 | Snow | |
| 2013/0053117 | A1 | 2/2013 | Snow | |
| 2013/0184059 | A1 | 7/2013 | Costello et al. | |
| 2013/0184079 | A1 | 7/2013 | Costello et al. | |
| 2013/0296025 | A1 | 11/2013 | Castle, II et al. | |

OTHER PUBLICATIONS

"Draw Poker," Wikipedia, http://en.wikipedia.org/wiki/Draw_poker, (Dec. 4, 2003), 6 pages.

Double Draw Poker—Wizard of Odds, "The Wizard of Odds, Double Draw Poker", http://wizardofodds.com/games/video-poker/tables/double-draw/, Copyright © 1998-2015 Wizard of Odds Consulting, Inc., Nov. 10, 2006, 3 pages, author unknown.

* cited by examiner

METHODS FOR ADMINISTERING A DOUBLE DRAW POKER CASINO CARD GAME

CROSS-REFERENCE TO RELATED APPLICATIONS

This application is a continuation-in-part of U.S. patent application Ser. No. 13/779,547, filed Feb. 27, 2013, which claims the benefit of U.S. Provisional Patent Application Ser. No. 61/744,339, filed Sep. 24, 2012, the disclosure of each of which applications is hereby incorporated in its entirety herein by this reference.

FIELD

This disclosure relates generally to methods of administering wagering games for casinos and other gaming establishments and to related apparatuses. More specifically, disclosed embodiments relate to methods of, and systems and apparatuses for, administering a wagering game including administration of up to multiple post-dealing bet events. A post-dealing bet event comprises accepting, from a player, a selection between options comprising a fold election and a draw bet election that initiates discarding and replacing a number of cards up to a predetermined limit.

BACKGROUND

Part of the excitement of poker card games is to be dealt a high scoring hand to win in a game of poker. Draw poker, with a single draw of up to three cards against a five-card hand, further increases the chance of being dealt a high scoring hand and, hence, the enticement to play and to bet on a five card poker hand.

Playing poker against other players with unlimited betting and raising opportunities increases the excitement of playing poker but does not increase the chance of winning a hand, which may sometimes last for many long rounds of betting and raising.

There is also an element of bluffing or using other tactics to win in a game of poker played against other players such that the highest scoring poker hand does not always win.

It is desirable to increase a player's chances of winning, to provide quicker games to allow a player more chances to win in a given time period, and to provide a game wherein there is a certainty of winning a specific amount of money for each specific five card poker hand.

BRIEF SUMMARY

The present disclosure relates to a method for playing a double draw poker casino card game. An exemplary method comprises providing a standard fifty-two card deck of playing cards for playing a standard draw poker casino card game and further providing two joker cards shuffled together with the standard fifty-two card deck. In embodiments, each of the two joker cards is valued as an ace, as a fill-in card for a straight, or as a fill-in card for a flush. Each player places an ante bet and a bonus bet and receives an initial hand, such as five dealt cards. The player may elect to fold or make a first optional draw card bet, enabling the player to discard and draw up to three draw cards. The player may elect to fold or make a second optional draw card bet enabling the player to discard and draw up to one draw card, producing a final double draw hand, such as a five card poker hand that receives a payout against a first payout table for the ante bet and draw bets and a second payout table for the bonus bet.

An object of the present invention is to provide a method of playing a double draw five card poker casino card game having a first optional draw of up to three cards and a second optional draw of up to one card to increase a player's chances of producing a high scoring five card poker hand by having two draws, instead of one draw, to improve a five card poker hand.

Another object of the present invention is to provide a method for playing a double draw five card casino poker game in which a payout is paid out against two specified payout tables with specific returns for specific five card poker hands for a fast and certain outcome for a player, thereby increasing the speed of the poker game, eliminating bluffing and other player strategies, which occur when trying to beat poker hands held by other players, and providing the certainty of knowing what the payout will be for each five card poker hand.

In brief, a method for a double draw poker casino card game of the present invention comprises a player receiving five dealt cards and having a first optional fold or draw opportunity; discarding and drawing up to three draw cards, and having a second optional fold or draw opportunity; discarding and drawing up to one draw card; producing a final double draw five card poker hand receiving a payout against a first payout table for the ante bet and draw bets and a second payout table for the bonus bet.

The method of the present invention of playing a double draw poker casino card game comprises:

a) a first act of providing a standard fifty-two card deck of playing cards for playing a standard draw poker casino card game and further providing two joker cards shuffled together with the standard fifty-two card deck, each of the two joker cards valued as an ace, as a fill-in card for a straight, or as a fill-in card for a flush;

b) a second act of placing an ante bet in a first location in front of each player;

c) a third act of placing a mandatory bonus bet in a second location in front of each player;

d) a fourth act of dealing five cards face down to each player;

e) a fifth act of the player viewing the player's own five dealt cards;

f) a sixth act of exercising an option to fold the player's own five dealt cards and forfeiting the player's ante bet and bonus bet, thereby ending the folding player's game for the hand; or an alternate sixth act of exercising an alternate option of placing, in a third location in front of the player, a first draw bet to discard and draw up to three cards;

g) a seventh act of discarding and drawing from zero to three cards thereby holding a five card hand;

h) an eighth act of exercising an option to fold the player's own held five card hand and forfeiting the player's ante bet, bonus bet, and first draw bet, thereby ending the folding player's game for the hand; or an alternate eighth act of exercising an alternate option of placing, in a fourth location in front of the player, a second draw bet to discard and draw up to one card;

i) a ninth act of discarding and drawing from zero to one card thereby holding a final five card hand;

j) a tenth act of paying out on the final five card hand for each player according to a first payout table, for the ante bet and draw bets, and a second payout table, for the bonus bet.

An advantage of the present invention is that it provides an opportunity to build higher scoring five card poker hands.

Another advantage of the present invention is that it provides a fast game of five card poker with definite specified payouts for different five card poker hands.

An added advantage of the present invention is that it provides three betting opportunities for a player.

Further embodiments may include one, some, or all of the following: The acts of the dealer may be carried out by a visual representation of a dealer, the visual representation being generated and/or displayed by a computer. The visual representation may be a virtual person (e.g., an animation) or may be a transmission (e.g., a video) of an actual person. The visual representation may be part of an online gaming experience of the disclosed game. The acts described in this disclosure associated with a dealer, including dealing cards, displaying or turning cards over, receiving or paying bets, or any other actions, may be represented in any way when used in an online environment. For example, the cards associated with a dealer action, described as being dealt or otherwise handled by a dealer, may appear as virtual cards or as transmitted pictures of physical cards. This may include a display of virtual card decks wherein each deck, individual card, and hand is displayed to an online player in a manner consistent with the game play disclosed herein, but may or may not include a visual representation of a dealer with the cards. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

Live, electronic, or online-implementations of the methods described herein may be configured for administration as either "play-for-pay" embodiments or "play-for-fun" embodiments. In play-for-pay embodiments, wagers having real-world monetary value are received and payouts having real-world monetary value may be distributed. Play-for-pay embodiments may include "house-banked" embodiments, "player-banked" embodiments, and "player-pooled" embodiments. In house-banked embodiments, payouts are paid by, and losses are retained by, the game administrator (e.g., a casino or other gaming establishment). In player-banked embodiments, payouts are paid by, and losses are retained by, a player acting as the game administrator, and the casino or other gaming establishment may profit from the game by, for example, "raking" the wagers (i.e., retaining a portion of the wagers for the house) or charging a seat or room fee in exchange for making the venue available for a predetermined time. In player-pooled embodiments (e.g., "player-pooled progressive" configurations, "dividend refund" configurations), wagers are raked by the game administrator and pooled into a pot from which payouts are paid, which pot is eventually distributed to at least one player; thus, the game administrator retains only the raked amounts. Unlike play-for-pay embodiments, play-for-fun embodiments (e.g., "free play-for-fun" configurations, "social play-for-fun" configurations) involve receiving wagers having no real-world monetary value and distributing payouts having no real-world monetary value.

The actions described in this disclosure as the acts of a player, including betting, card selection (if any), card evaluation, card discards, play elections, or any other actions, may be carried out over a network where the indicated actions are received as input to a device (e.g., a user device). The input-receiving device is typically physically remote from the game server or game host and is connected over a long-distance network, but may also be implemented over a wired or wireless LAN in one building, or even in one room, for example. In one embodiment, game play generated at the server or host location may be displayed on the same device receiving input. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touch screens, buttons, mice, optical location devices, eye movement/location detectors, sound input devices, etc. When discussing a device, it is understood the device may comprise multiple components and may be complex, including hardware components combined with firmware and/or software, and may itself be a subcomponent of a larger system.

Yet other embodiments may comprise apparatuses and systems for administering wagering games according to embodiments of the disclosure.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
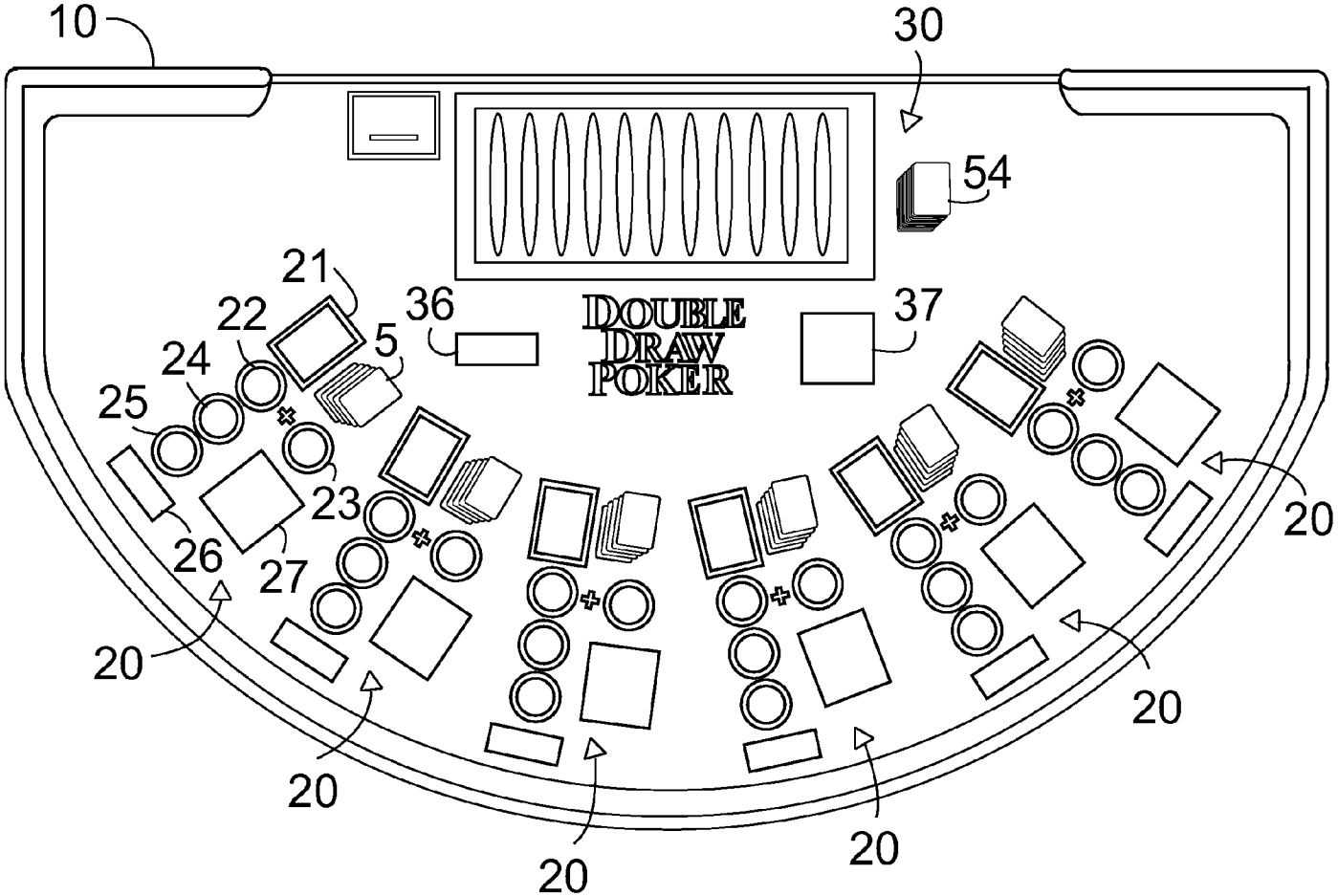
FIG. 1 is a plan view showing a double draw poker casino card game playing table showing the player layouts and pay tables facing the players and the dealer layout and pay tables facing the dealer on the other side of the playing table from the players.

The illustrations presented in this disclosure are not meant to be actual views of any particular act in a method of administering a wagering game, apparatus for use in administering a wagering game, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix. For example, elements 100*a*, 100*b*, and 100*c*, may be a device that is instantiated three times and generically referred to as element 100.

The terms "gaming," "gambling," or the like, refer to activities, games, sessions, rounds, hands, rolls, operations, and other events related to wagering games such as web-based games, casino games, card games, dice games, and other games the outcome of which is at least partially based on one or more random events ("chance" or "chances") and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked," "player-banked," "player-pooled" including "player-pooled progressive," and "dividend refund" configurations, each of which is described in more detail below) or in wagering games that involve no real-world monetary risks for the player (e.g., the "play-for-fun" and "social play-for-fun" configurations described in more detail below).

Moreover, as used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local gaming table e.g., casino gaming table 10 (FIG. 1), gaming table 200 (FIG. 10), table 400 with electronic wagering interface (FIG. 12), or an all electronic table 500 (FIG. 13)), as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device (e.g., casino gaming table 100 (FIG. 1), gaming table 200 (FIG. 10), interactive electronic gaming system 300 (FIG. 11), table 400 (FIG. 12), table 500 (FIG. 13), gaming servers 610 (FIG. 14), user device 620 (FIGS. 14 and 15), account server 632 (FIG. 14), or computing system 640 (FIG. 16)). As used herein, the term "wagering element" means and includes objects and symbols used to signify the acceptance of a wager. For example, physical wagering elements include physical money (e.g., bills and coins) and physical wagering tokens (e.g., poker chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, making payouts, dealing cards, selecting cards, or other actions associated with a player or a dealer are described, the description includes a player or a dealer taking the action, the results of the action on a live or virtual table or display, and, if applicable, the reception or detection of such an action in an electronic form wherein player and dealer choices, selections, or other actions are received at an electronic interface. This further includes the results of a virtual dealer and virtual players, where the actions described are actually generated by a computer (typically associated with an online game). By way of a further example, if dealing of a card is described herein, the description includes (but is not limited to) the following: the distribution of a card by a dealer from a deck, shuffler, shoe, or other card source and the reception or placement of the card at a table location associated with a player or reception directly by a player; the generation and transmission of an electronic indication (e.g., an "indicia") or representation of a card from a game play source or server to an electronic receiver, wherein the receiver may be at a table (using virtual cards) including players and/or virtual players and/or a dealer or virtual dealer, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player, or, associated with a virtual player.

In FIGS. 1-9, an exemplary method for a double draw poker casino card game includes a player receiving five dealt cards and having a first optional fold or draw opportunity; discarding and drawing up to three draw cards, and having a second optional fold or draw opportunity; discarding and drawing up to one draw card; producing a final double draw five card poker hand that receives a payout according to a first payout table 26/36, for an ante bet and draw bets, and a payout according to a second payout table 27/37, for a bonus bet.

In FIGS. 1-5 and 9, the method of playing an exemplary double draw poker casino card game comprises:

a) a first act of providing a standard fifty-two card deck of playing cards for playing a standard draw poker casino card game and further providing two joker cards shuffled together with the standard fifty-two card deck to make a fifty-four card deck 54, as shown in FIG. 1, each of the two joker cards valued as an ace, as a fill-in card for a straight, or as a fill-in card for a flush;

b) a second act of placing an ante bet in a first bet location 22 in front of each player in a player layout 20;

c) a third act of placing a mandatory bonus bet in a second bet location 23 in front of each player;

d) a fourth act of dealing five cards 5 face down to each player;

e) a fifth act of the player viewing the player's own dealt five cards 5;

f) a sixth act of exercising an option to fold the player's own dealt five cards 5 and forfeit the player's ante bet and bonus bet, thereby ending the folding player's game for the hand; or an alternate sixth act of exercising an alternate option to place, in a third bet location 24 in front of the player, a first draw bet to discard and draw up to three cards;

g) a seventh act of discarding, onto a discard location 21 in front of the player, and drawing from the deck 54 from zero to three cards, thereby holding a five card hand;

h) an eighth act of exercising an option to fold the player's own held five card hand and forfeit the player's ante bet, bonus bet, and first draw bet, thereby ending the folding player's game for the hand; or an alternate eighth act of exercising an alternate option to place, in a fourth bet location 25 in front of the player, a second draw bet to discard and draw up to one card;

i) a ninth act of discarding onto the discard location 21, in front of the player, and drawing from the deck 54 from zero to one card, thereby holding a final five card hand;

j) a tenth act of paying out on the final five card hand for each player according to the first payout table 26/36, for the ante bet and draw bets, and according to the second payout table 27/37, for the bonus bet.

In the third act, placing a mandatory bonus bet preferably comprises placing a bonus bet equal to the ante bet.

In the alternate sixth act, exercising an alternate option to place a first draw bet preferably comprises placing a first draw bet equal to the ante bet.

In the alternate eighth act, exercising an alternate option to place a second draw bet preferably comprises placing a second draw bet equal to the ante bet.

Figure 2:
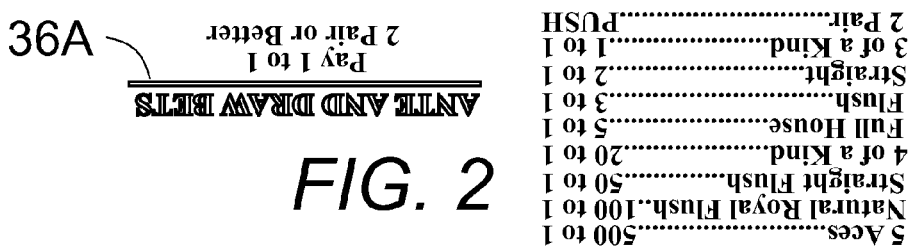
FIG. 2 is an enlarged plan view showing a first embodiment of the double draw poker casino card game playing table payout tables facing the dealer (appearing upside-down to the players)
Figure 3:
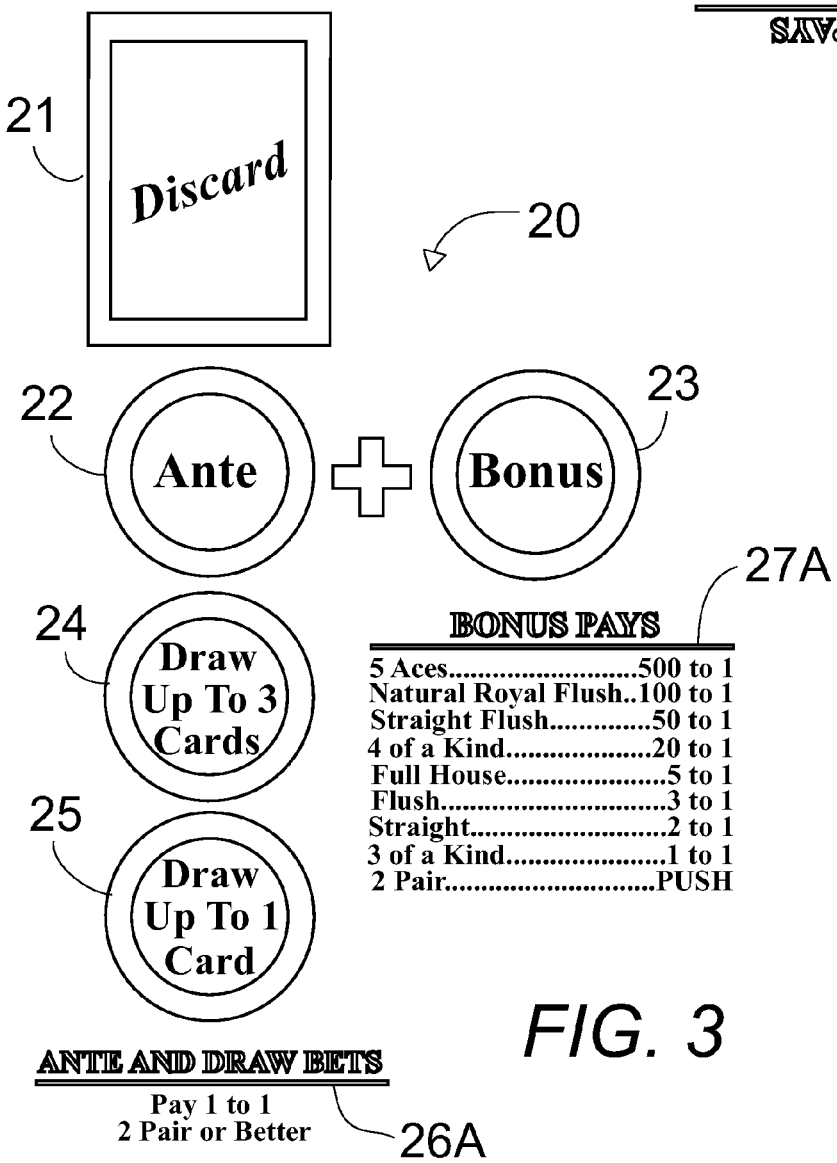
FIG. 3 is an enlarged plan view showing a first embodiment of a player layout and payout tables of the double draw poker casino card game playing table facing a player.

In FIGS. 2-3, the tenth act comprises paying out, on the final five card hand for each player, according to a first payout table 26A/36A by paying out, for the ante bet and each draw bet, 1 to 1 for two pair or better, and according to a second payout table 27A/37A by paying out, for the bonus bet, 500 to 1 for five aces, 100 to 1 for a natural royal flush, 50 to 1 for a straight flush, 20 to 1 for a four of a kind, 5 to 1 for a full house, 3 to 1 for a flush, 2 to 1 for a straight, 1 to 1 for a three of a kind, and push for two pair.

Figure 4:
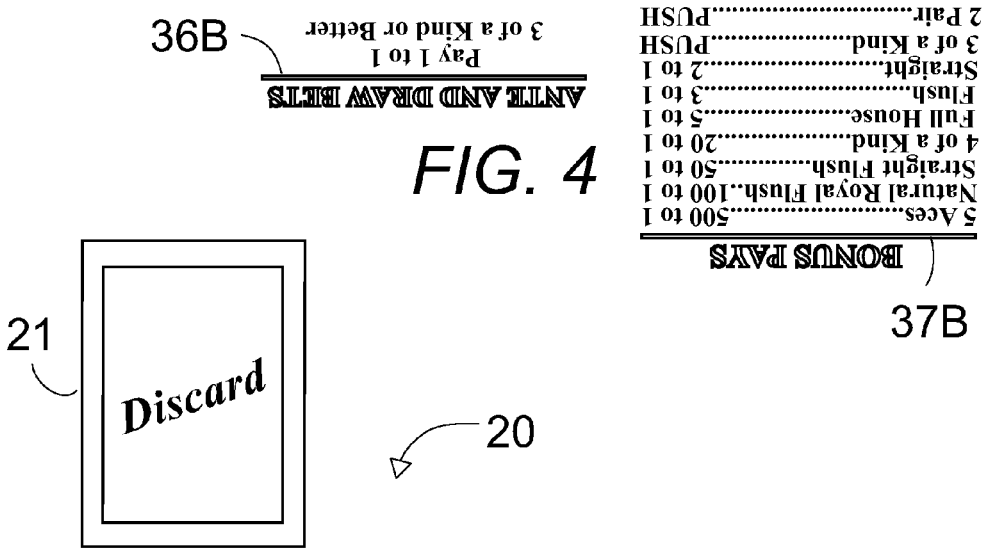
FIG. 4 is an enlarged plan view showing a second embodiment of the double draw poker casino card game playing table payout tables facing the dealer (appearing upside-down to the players)
Figure 5:
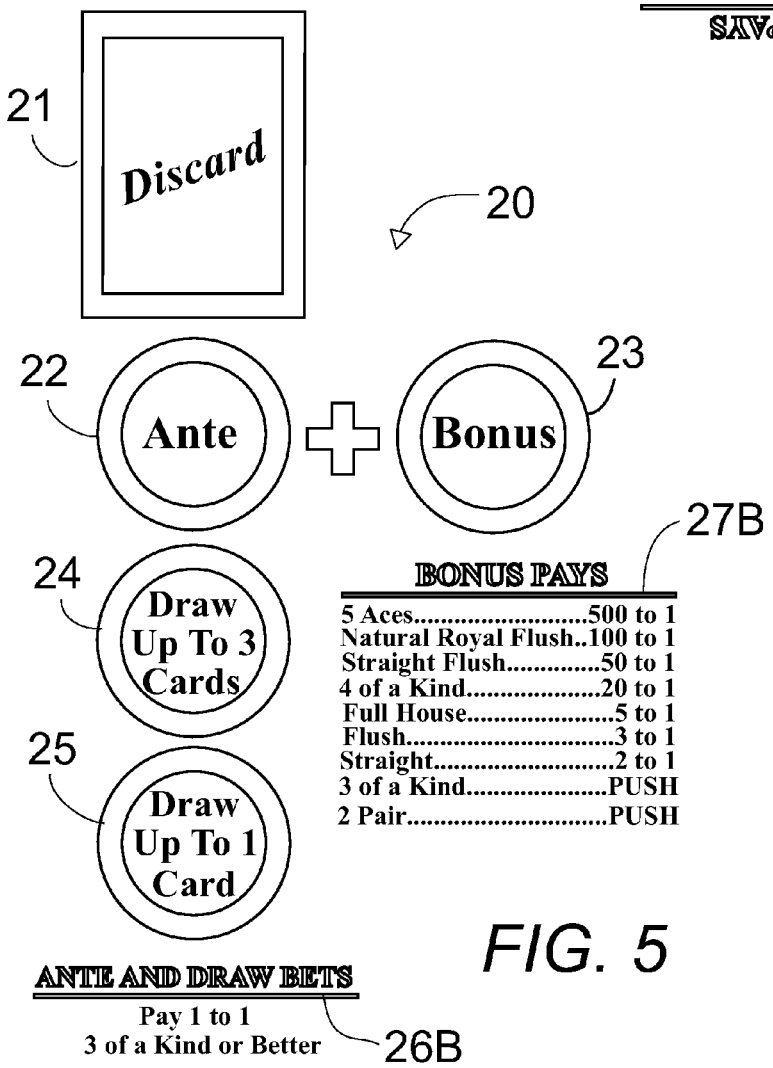
FIG. 5 is an enlarged plan view showing a second embodiment of a player layout and payout tables of the double draw poker casino card game playing table facing a player.

In FIGS. 4-5, the tenth act comprises paying out, on the final five card hand for each player, according to a first payout table 26B/36B by paying out, for the ante bet and each draw bet, 1 to 1 for two pair or better, and according to a second payout table 27B/37B by paying out, for the bonus bet, 500 to 1 for five aces, 100 to 1 for a natural royal flush, 50 to 1 for a straight flush, 20 to 1 for a four of a kind, 5 to 1 for a full house, 3 to 1 for a flush, 2 to 1 for a straight, push for a three of a kind, and push for two pair.

In FIGS. 1-5, the method comprises an act of providing a casino gaming table 10 for playing the double draw poker casino card game. Each player carries out the acts of the double draw poker casino card game by sitting at the casino gaming table 10 with other players, each in front of the player layout 20, and a dealer in front of a dealer layout 30. Each player further carries out the acts of the method of the double draw poker casino card game by physically playing with the five cards 5, dealt by the dealer from the deck of fifty-four cards 54, which deck 54 includes two jokers, and physically placing bets on the first bet location 22, the second bet location 23, the third bet location 24, and the fourth bet location 25 (also referred to herein, respectively, as designated ante location 22, bonus location 23, and draw locations 24 and 25) on the player layout 20, in front of each player, in a double draw poker casino card game, which player layout 20 is shown in detail in FIGS. 3 and 5. Bets and payouts may be made using poker chips, other tokens of monetary value, or actual money.

In FIGS. 1-8, the method may alternately comprise an act of providing a simulation device for playing the double draw poker casino card game. A player may carry out the acts of the double draw poker casino card game, using the simulation device, by manipulating the simulation device by placing simulation bets on the designated ante location 22, the bonus location 23, and the draw locations 24 and 25 in a double draw poker casino card game player layout, on the simulation device, which player layout may be similar to the player layouts 20 of the casino table 10 of FIG. 1.

In FIGS. 1-5, the method may alternately comprise an act of providing a mechanical simulation device, such as a game board similar to the casino table 10, for playing the double draw poker casino card game. The method utilizing the game board comprises an additional act of selecting a player/dealer to sit in front of the dealer layout 30 to deal the cards and make the payouts. The players may alternate being the player/dealer. The method of playing the double draw casino poker game on the mechanical simulation device comprises each player carrying out the acts of the double draw poker casino card game using the mechanical simulation device by physically playing with the five cards 5 dealt by a player dealer from the fifty-four card deck 54 and physically placing bets on the designated ante location 22, the bonus location 23, and the draw locations 24 and 25 on the double draw poker casino card game player layout 20 in front of each player on the mechanical simulation device. Similar to the method played on an actual casino gaming table (e.g., the casino gaming table 10), bets and payouts may be made using poker chips, other tokens of monetary value, or actual money in the method using the game board.

Figure 6:
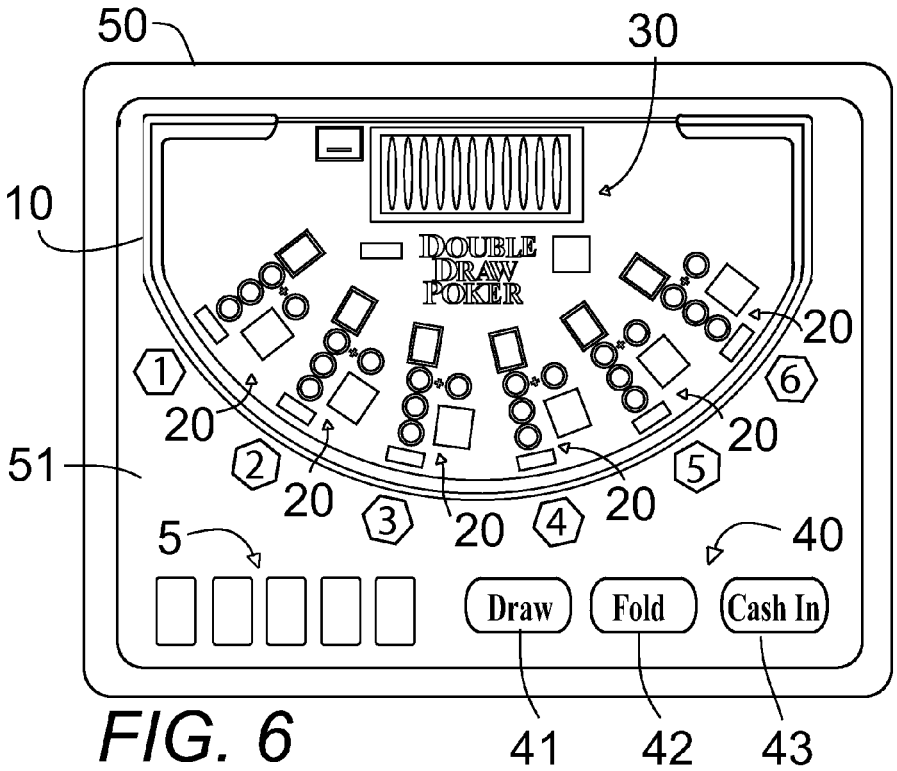
FIG. 6 is an elevational view of a simulation of the double draw poker casino card game playing table layout, shown on a screen of an electronic simulation device and showing a simulation of the player layouts and pay tables, the dealer layout and pay tables, and the five cards held by a player.
Figure 7:
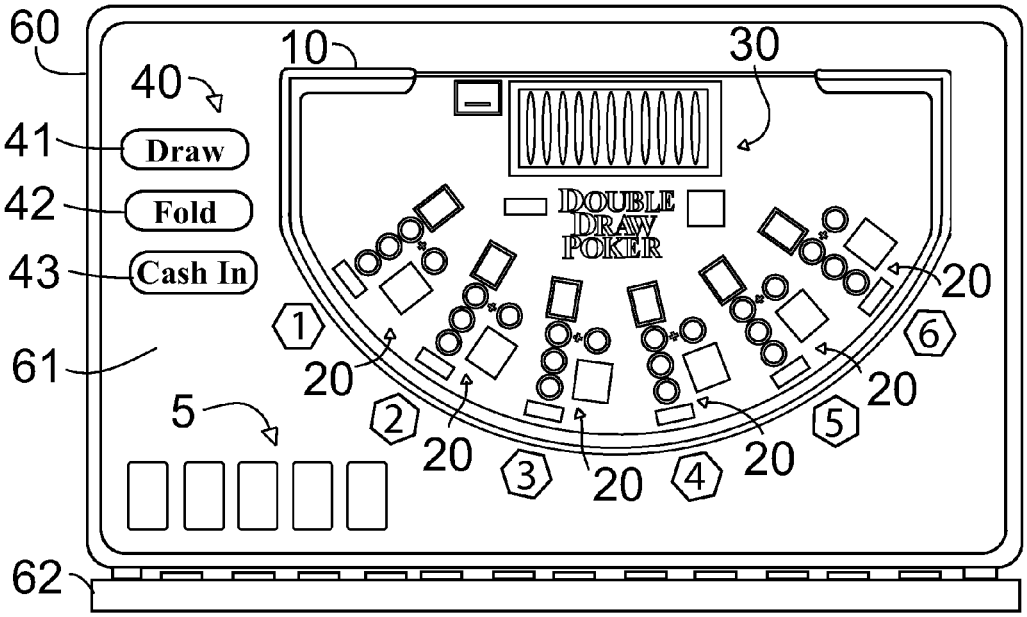
FIG. 7 is an elevational view of a simulation of the double draw poker casino card game playing table layout, shown on a screen of a computer device and showing a simulation of the player layouts and pay tables, the dealer layout and pay tables, and the five cards held by a player.
Figure 8:
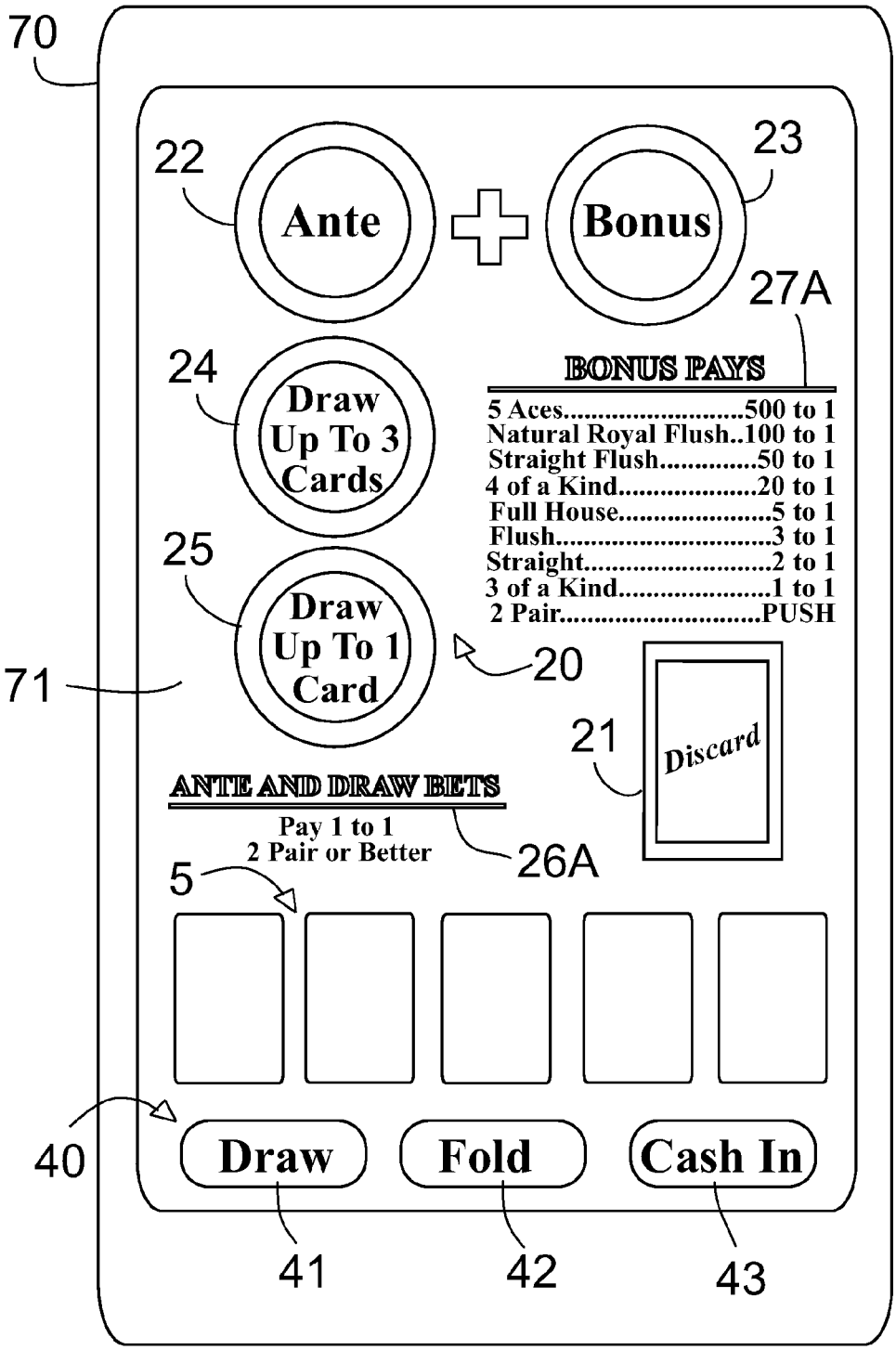
FIG. 8 is an elevational view of a simulation of a player layout for the double draw poker casino card game playing table layout, shown on a screen of a wireless device and showing a simulation of the player layouts and pay tables and the five cards held by a player.

In FIGS. 6-8, the method comprises an act of providing an electronic simulation device 50, 60, or 70 for playing the double draw poker casino card game. The electronic simulation device 50, 60, or 70 comprises a screen 51, 61, or 71 showing a virtual representation of the five cards 5 dealt to a player and showing a virtual representation of at least one double draw poker casino card game player layout 20. The electronic simulation device 50, 60, or 70 further comprises means for a player to interact with the electronic simulation device 50, 60, or 70. Each player carries out the acts of the double draw poker casino card game using the electronic simulation device 50, 60, or 70 by inputting commands on the designated ante location 22, bonus location 23, and draw locations 24 and 25 (collectively also referred to herein as the betting locations 22, 23, 24, and 25), on the hand of the five cards 5, and on additional inputting locations 40, including a draw location 41, a fold location 42, and a cash in location 43. Virtual bets are input to the designated ante location 22, bonus location 23, and draw locations 24 and 25 in the virtual double draw poker casino card game player layout on the screen 51, 61, or 71. After inputting a command for a bet in a first draw location (e.g., the draw location 24), a player inputs commands to indicate which zero to three virtual cards of the five cards 5 are to be discarded and replaced by virtual draw cards by inputting commands to touch any cards to be discarded from the five card hand 5 and then a command to contact the discard location 21 and then contact the draw location 41. Alternatively, the hand may be folded by inputting a command to contact the fold location 42. After receiving the draw cards to replace the discard cards, a command may be input for a bet in a second draw location 25 (e.g., the draw location 25). A player inputs commands to indicate which zero to one virtual cards of the hand of five cards 5 are to be discarded and replaced by a virtual draw card by optionally inputting a command to touch the card to be discarded from the five card hand 5, then a command to contact the discard location 21, and then a command to contact the draw location 41. Alternately, the hand may be folded by inputting a command to contact the fold location 42. After all optional draws have been made and the final five card hand of cards 5 is complete, the method includes cashing in by inputting a command to contact the cash in location 43.

In FIG. 6, an embodiment of the method of the present invention comprises an act of providing the electronic device 50, which may be a television or other entertainment or communication device, a gaming device, a computer device, or other electronic simulation device having a viewing screen (e.g., the screen 51), showing the entire simulation of the double draw poker casino card game with the dealer layout 30 and the player layouts 20, each indicated by a player number of one to six inside of a hexagon in front of the player layout 20, for inputting a command to contact the desired player location hexagon for each player, as well as having the additional inputting locations 40. The method of play is carried out according to the method indicated above for the electronic simulation device 50, 60, or 70. The acts involving inputting commands are accomplished by using controls for inputting commands found on gaming devices, computer devices, television and other entertainment and communication devices, or other electronic simulation device controls.

In FIG. 7, an embodiment of the method of the present disclosure comprises an act of providing a computer device (e.g., the electronic simulation device 60), which may be a laptop, a desktop, or other computer device having a keyboard 62 and having a viewing screen (e.g., the screen 61), showing the entire simulation of the double draw poker casino card game, with the dealer layout 30 and the player layouts 20, each indicated by a player number of one to six inside of a hexagon in front of the player layout 20, for inputting a command to contact the desired player location hexagon for each player, as well as having the additional inputting locations 40. The method of play is carried out according to the method indicated above for the electronic simulation device 50, 60, or 70. The acts involving inputting commands are accomplished by using keyboard controls, a mouse, or other computer input controls for inputting commands to carry out the acts of the method.

In FIG. 8, an embodiment of the method of the present disclosure comprises an act of providing a handheld electronic simulation device (e.g., the electronic simulation device 70) for playing the double draw poker casino card game. The handheld electronic simulation device (e.g., the electronic simulation device 70) comprises a touch screen (e.g., the screen 71) as a means for interacting with the handheld electronic simulation device (e.g., the electronic simulation device 70. A player touches the screen 71 to play the game using the method of the present invention wherein all of the inputting as indicated above is accomplished by touching the screen 71 in each of the desired locations. The handheld device (e.g., the electronic simulation device 70) may be a smart phone, a handheld gaming device, or other communication or entertainment devices. The display screen (e.g., the screen 71) indicates a virtual display of the player layout 20, as well as has the additional inputting locations 40. The method of carrying out the embodiment of the method of the game is accomplished by inputting commands by touching the screen 71 according to the method indicated above for electronic simulation devices 50, 60, 70.

The act of providing an electronic simulation device may comprise providing an electronic simulation device having a connection to a remote network for playing the double draw poker casino card game, wherein a player uses the electronic simulation device having the connection to the remote network to play the game using an embodiment of the method of the present disclosure.

The act of providing an electronic simulation device may comprise providing an electronic simulation device having a wired connection to a remote network for playing the double draw poker casino card game, wherein a player uses the electronic simulation device having the wired connection to the remote network to play the game using an embodiment of the method of the present disclosure.

The act of providing an electronic simulation device may comprise providing an electronic simulation device having a wireless connection to a remote network for playing the double draw poker casino card game, wherein a player uses the electronic simulation device having the wireless connection to the remote network to play the game using an embodiment of the method of the present disclosure.

The act of providing a communication electronic simulation device may comprise providing a communication electronic simulation device having a connection to a remote network for playing the double draw poker casino card game, wherein a player uses the communication electronic simulation device having the connection to the remote network to play the game using an embodiment of the method of the present disclosure.

The method, wherein a player uses the electronic simulation device having the connection to the remote network for playing the double draw poker casino card game using an embodiment of the method of the present disclosure comprises using a device taken from the list of electronic simulation devices comprising a computer, a handheld device, a telephonic device, an entertainment device, a gaming device, and a television device.

In use, the present method comprises a first act of providing a standard fifty-two card deck of playing cards for playing a standard draw poker casino card game and providing two joker cards shuffled together with the standard fifty-two card deck, each of the two joker cards being valued as an ace, as a fill-in card for a straight, or as a fill-in card for a flush. The method further comprises acts of each player placing an ante bet and a bonus bet and receiving five dealt cards. The method then comprises acts of each player either folding or making a first optional draw card bet and discarding and drawing up to three draw cards. The method then comprises acts of each player folding or making a second optional draw card bet and discarding and drawing up to one draw card, producing a final double draw five card poker hand. The method comprises a final act of each player having the final double draw five card poker hand receiving a payout against a first payout table, for the ante bet and draw bets, and against a second payout table, for the bonus bet.

Figure 9A:
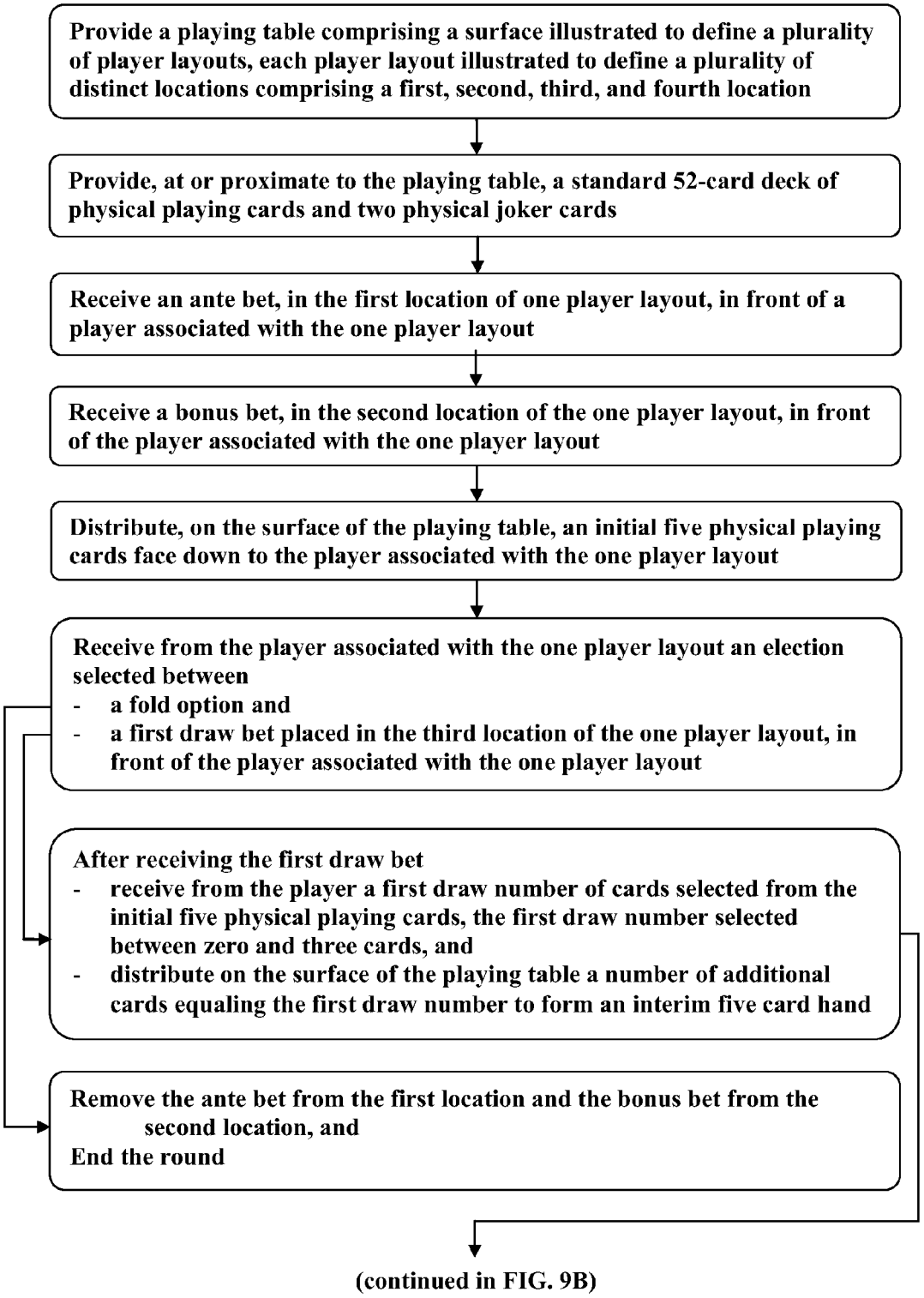
FIGS. 9A and 9B show a flow diagram for a method according to an embodiment of the present disclosure, FIG. 9B continuing from FIG. 9A.
Figure 9B:
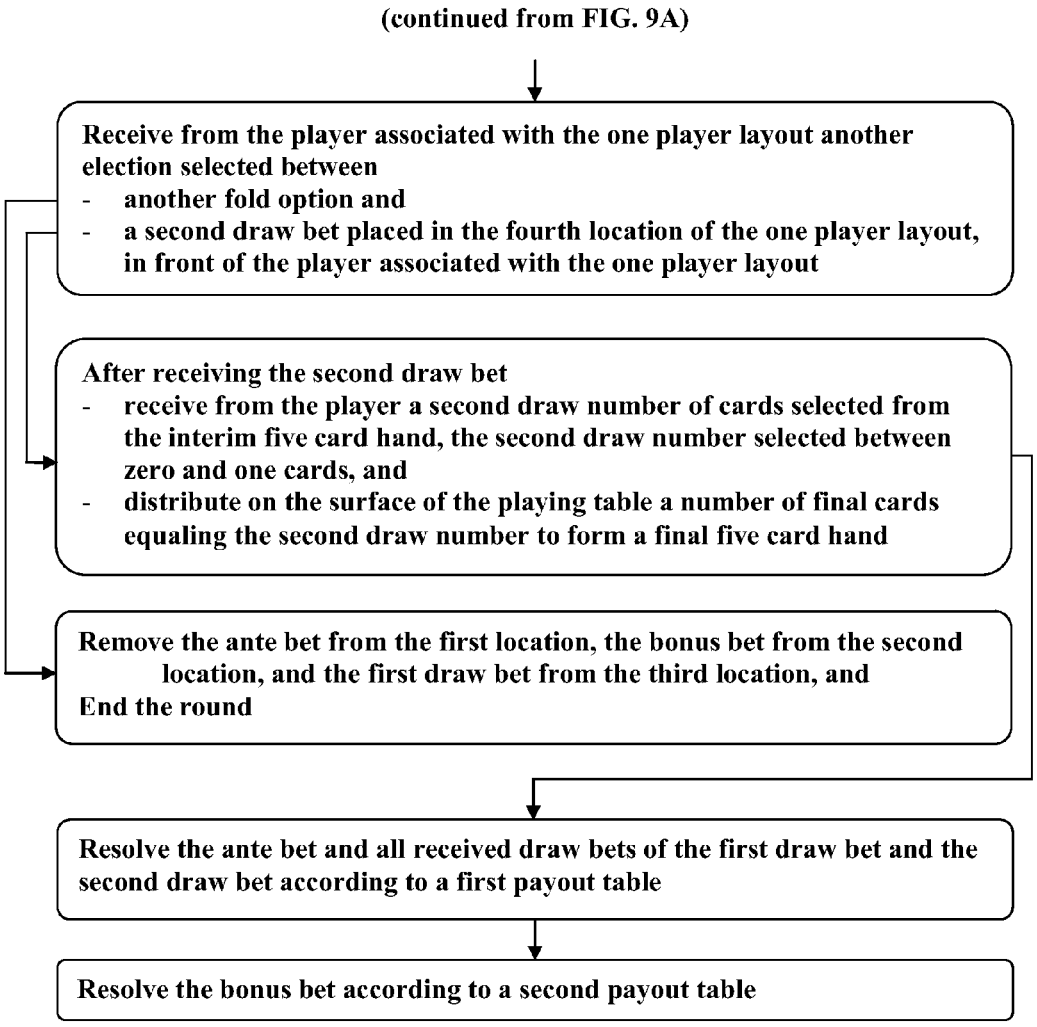

Referring to FIGS. 9A and 9B, a flowchart diagram of an exemplary method of administering a wagering game is shown. The method includes providing a playing table comprising a surface illustrated to define a plurality of player layouts. Each player layout is illustrated to define a plurality of distinct locations comprising a first, second, third, and fourth location. A standard fifty-two card deck of physical playing cards and two physical joker cards are provided at or proximate to the playing table. An ante bet is received, in the first location of one player location, in front of a player associated with the one player layout. A bonus bet is received, in the second location of the one player layout, in front of the player associated with the one player layout. An initial five physical playing cards are distributed, on the surface of the playing table, face down to the player associated with the one player layout. Then, an election is received from the player. The election is selected between a fold option and a first draw bet placed in the third location of the one player layout, in front of the player associated with the one player layout. If the election is selected to be the fold option, the ante bet is removed from the first location, the bonus bet is removed from the second location, and the round ends. If the election is selected to be the first draw bet, the administrator receives the first draw bet. After receiving the first draw bet, the administrator receives from the player a first draw number of cards. The first draw number of cards is selected from the initial five physical playing cards and is selected between zero and three cards. A number of additional cards, equaling the first draw number, is distributed on the surface of the playing table to form an interim five card hand. The administrator receives from the player associated with the one player layout another election selected between another fold option and a second draw bet placed in the fourth location of the one player layout, in front of the player associated with the one player layout. If the another election is selected to be the another fold option, the ante bet is removed from the first location, the bonus bet is removed from the second location, the first draw bet is removed from the third location, and the round ends. Alternatively, if the another election is selected to be the second draw bet, the administrator receives the second draw bet. After receiving the second draw bet, the administrator receives from the player a second draw number of cards selected from the interim five card hand. The second draw number is selected between zero and one cards. A number of final cards, equaling the second draw number, is distributed on the surface of the playing table to form a final five card hand. The ante bet and all received draw bets of the first draw bet and the second draw bet are resolved according to a first payout table. The bonus bet is resolved according to a second payout table.

Various platforms are contemplated that are suitable for implementation of embodiments of wagering games according to this disclosure. For example, embodiments of wagering games may be implemented such that wagers may be received from one or more players, and game play may be administered with the one or more players according to the rules of the wagering games. For example, wagering games may be implemented on gaming tables, which may include physical gaming features, such as physical cards and physical chips, and may include a live dealer and a shuffler or shoe. More specifically, a live dealer may deal physical cards, evaluate hands, accept wagers, accept player elections, issue payouts, and perform other administrative functions of game play. Some embodiments may be implemented on electronic devices enabling electronic gaming features, such as providing electronic displays for display of virtual cards, virtual chips, game instructions, pay tables, etc. Some embodiments may include features that are a combination of physical and electronic features.

As an example, embodiments of wagering games may be implemented on an individual gaming device, such as a video poker machine, configured to accept wagers and having a display screen and input devices for enabling game play of the wagering games. Such an individual gaming device may be linked with other gaming devices that may be operated, for example, by other players. Some individual electronic gaming devices may be referred to as an individual player "electronic gaming machine" and may be stationary, such as being located on a casino floor. Other individual electronic gaming devices may be portable devices that may be carried to different locations by the player. Portable devices may include both display of the ongoing game play and input reception for game play by a player. Portable devices may, alternatively or additionally, be configured for receiving input from a player while the game play is displayed on a public monitor or other display device. Game play and game outcomes may also be displayed on a portable device.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, or on a legally-authorized site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station or proximate to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely-located players are disclosed in U.S. Pat. No. 6,755,741 B1, issued Jun. 29, 2004, titled "Gambling Game System and Method for Remotely-Located Players," the disclosure of which is incorporated herein in its entirety by this reference, and in connection with FIGS. 13 and 14.

In some embodiments, the wagering games described herein may be played against the game administrator, i.e., "the house" (i.e., be "house-banked"), which may involve the game administrator (e.g., a casino or other gaming establishment) receiving (via a dealer who may be employed by the administrator) wagers having real-world monetary value, comparing a player hand against pay tables, distributing payouts having real-world monetary value to winning players, and retaining lost wagers. For example, physical chips or other tokens of real-world monetary value may be received from a player for the ante bet, the bonus bet, and the draw bets; the physical cards may be distributed on a table surface and received on the table surface when discarded; and payouts may be paid on the table surface in the form of additional physical chips or other tokens of real-world monetary value, with such payouts being paid from funds of the game administrator. Such "house-banked" embodiments may be implemented in the form of a live table game, in a virtual table game, in an electronic game, or in an online game configuration.

In other embodiments, the wagering games, or at least one wager associated with the wagering game, may involve a player acting as banker, accepting wagers having real-world monetary value, issuing payouts having real-world monetary value, and retaining lost wagers (i.e., be "player-banked"). More specifically, player-banked games may be administered live in a casino or other gaming establishment utilizing physical cards and betting chips. The player acting as banker retains wagers lost by the other players, and the casino or other gaming establishment may collect a player entrance fee or a rake on each wager from the participating players, including the banker. For example, a player-banker may receive the ante bet, the bonus bet, and the draw bets in the form of physical chips or other tokens of real-world monetary value. The gaming establishment may take a rake on the received bets. The wagering game may be administered as described above, but with losses on the ante bet, the bonus bet, and the draw bets being retained by the player-banker, and payouts on the bets being paid from funds of the player-banker, the gaming establishment profiting in the form of rakes, or other fee, but not directly based on the losses.

Figure 10:
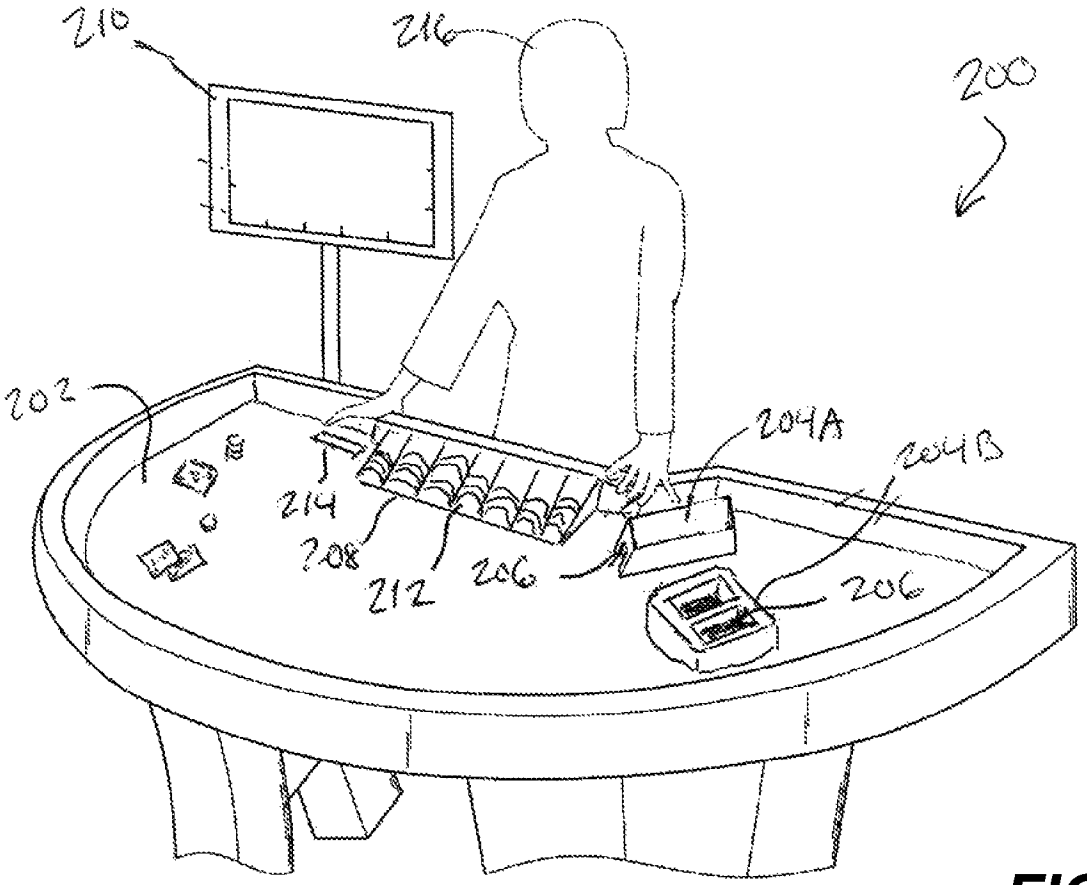
FIG. 10 is a perspective view of a gaming table configured for implementation of embodiments of wagering games in accordance with this disclosure.

Referring to FIG. 10, a perspective view of a casino gaming table 200 configured for implementation of embodiments of wagering games in accordance with this disclosure is shown. The gaming table 200 may be a physical article of furniture around which participants in the wagering game may stand and on which the physical objects used for administering and otherwise participating in the wagering game may be supported, positioned, moved, transferred and otherwise manipulated. For example, the gaming table 200 may include a gaming surface 202 on which the physical objects used in administering the wagering game may be located. The gaming surface 202 may be, for example, a felt fabric covering a padded hard surface of the table, and a design, conventionally referred to as a "layout," specific to the wagering game being administered (e.g., the player layout 20 (FIG. 1), the dealer layout 30 (FIG. 1), the first payout table 26A/36A and 26B/36B (FIGS. 2 through 5), and the second payout table 27A/37A and 27B/37B (FIGS. 2 through 5) may be physically printed on the gaming surface 202. For example, the gaming surface 202 may include designated areas for player positions; areas in which one or more of player cards or community cards may be dealt; areas in which wagers may be accepted; areas in which wagers may be grouped into pots; and areas in which rules, paytables, and other instructions related to the wagering game may be displayed. As a specific, nonlimiting example, the gaming surface 202 may be configured as shown in any of FIGS. 1 through 5. In some embodiments, the gaming table 200 may include a display 210 separate from the gaming surface 202. The display 210 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 210 may be a physically fixed display, such as a poster, in some embodiments. In other embodiments, the display 210 may change automatically in response to a stimulus (e.g., may be an electronic video monitor).

The gaming table 200 may include particular machines and apparatuses configured to facilitate the administration of the wagering game. For example, the gaming table 200 may include one or more card-handling devices 204. The card-handling device 204A may be, for example, a shoe from which physical cards 206 from one or more decks of playing cards may be withdrawn, one at a time. Such a card-handling device 204A may include a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent App. Pub. No. 2010/0038849, published Feb. 18, 2010, and titled "Intelligent Automatic Shoe and Cartridge," the disclosure of which is incorporated herein in its entirety by this reference. The card-handling device 204B may be, for example, a shuffler configured to randomly order physical cards 206 from one or more decks of playing cards and present randomized cards 206 for use in the wagering game. Such a card-handling device 204B may include a housing, a shuffling mechanism configured to shuffle cards, and card inputs and outputs (e.g., trays). Additional details of an illustrative card-handling device 204B configured as a shuffler capable of delivering randomly arranged hands of cards are found in U.S. Pat. No. 7,766,332, issued Aug. 3, 2010, to Grauzer et al., the disclosure of which is incorporated herein in its entirety by this reference. The card-handling device 204 may also be, for example, a combination shuffler and shoe in which the output for the shuffler is a shoe. The card-handling device 204 may simply be supported on the gaming surface 202 in some embodiments. In other embodiments, the card-handling device 204 may be flush mounted to the gaming table 202 or mounted such that the card-handling device 204 is not manually removable from the gaming table 202 without the use of tools. In some embodiments, the deck or decks of playing cards used may be standard, 52-card decks. In other embodiments, the deck or decks used may include cards, such as, for example, jokers (e.g., two jokers), wild cards, bonus cards, etc.

The type of card-handling device 206 employed to administer embodiments of the disclosed wagering game, as well as the type of card deck employed and the number of decks, may be specific the game to be implemented. For example, the card-handling device 206 may be programmed to distribute sets of five cards for forming the initial player hand from at least fifty-four cards (e.g., a standard fifty-two card deck with two joker cards). The card-handling device 206 may be further programmed to provide draw cards on demand, such as a pack of three cards, such that a dealer may distribute, from the card-handling device 206, between zero and three cards during a first draw bet event and then deal a second card, such that the dealer can deliver between zero and one cards during a second draw bet event.

The gaming table 200 may include a chip rack 208 configured to facilitate the acceptance of wagers, the transfer of lost wagers to the house, and the exchange of monetary value for wagering tokens 212 (e.g., poker chips). For example, the chip rack 208 may include a series of token support rows, each of which may support tokens of a different type (e.g., color and denomination). In some embodiments, the gaming table 200 may include a deposit 214 for money that is accepted in exchange for wagering tokens 212. The deposit 214 may be, for example, a secure container (e.g., a safe or lockbox) having a one-way opening into which money may be inserted and a secure, lockable opening from which money may be retrieved. Such deposits 214 are known in the art as "drop boxes." They may be incorporated directly into the gaming table 200 and may, in some embodiments, have a removable container for the retrieval of money in a separate, secure location.

When administering a wagering game in accordance with embodiments of this disclosure, a dealer 216 may receive money (e.g., cash) from a player in exchange for wagering tokens 212. The dealer 216 may deposit the money in the deposit 214 and transfer physical wagering tokens 212 to the player. The dealer 216 may accept one or more initial wagers (e.g., antes and other wagers) from the player, which may be reflected by the dealer 216 permitting the player to place one or more wagering tokens 212 or other wagering elements (e.g., cash) within designated areas on the gaming surface 202 associated with the various wagers of the wagering game. Once initial wagers have been accepted, the dealer 216 may remove physical cards 206 from the card-handling device 204 and position them within designated areas on the gaming surface 202, which may designate the cards 206 for use as individual player cards, or, in some embodiments, community cards, in accordance with game rules. After dealing the cards 206, any additional wagers (e.g., draw bets) may be accepted, which may be reflected by the dealer 216 permitting the player to place one or more wagering tokens 212 within designated areas on the gaming surface 202 associated with the various wagers of the wagering game. In some embodiments, a player may fold, which may result in the dealer 216 collecting at least one of the wagering tokens 212 from that player and transferring it to the house, which may be reflected by the wagering token 212 being returned to the chip rack 208. The dealer 216 may perform any additional card dealing and rounds of betting permitted in the wagering game. Finally, the dealer 216 may resolve the wagers, award winning wagers to the players, which may be accomplished by giving wagering tokens 212 from the chip rack 208 to the players, and transfer losing wagers to the house, which may be accomplished by moving wagering tokens 212 from the players to the chip rack 208.

Figure 11:
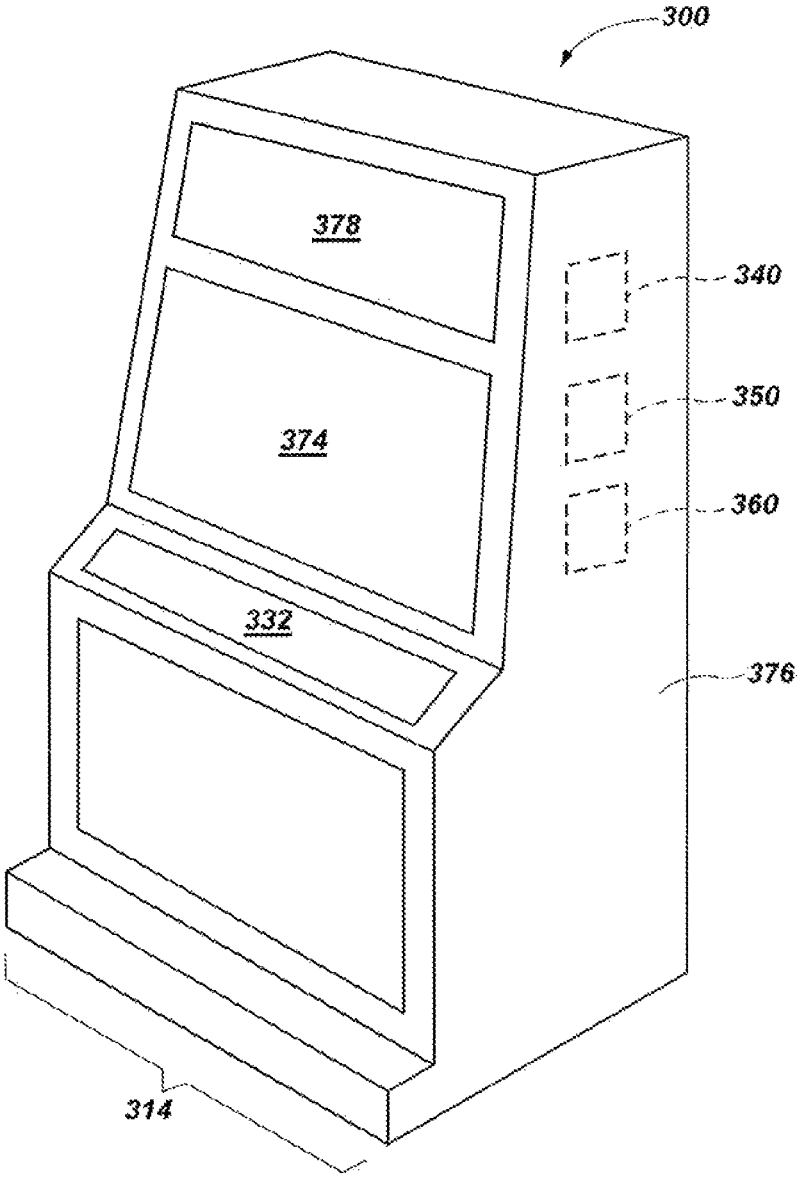
FIG. 11 is a perspective view of an individual electronic gaming device configured for implementation of embodiments of wagering games in accordance with this disclosure.

Referring to FIG. 11, illustrated is an example of an individual electronic gaming device 300 (e.g., an electronic gaming machine (EGM)) configured for implementation of embodiments of wagering games according to the present disclosure. The individual electronic gaming device 300 may include an individual player position 314 that includes a player input area 332 configured to enable a player to interact with the individual electronic gaming device 300 through various input devices (not shown). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, poker chips, and/or live personnel. The action may instead be simulated by a control processor 350 operably coupled to the memory 340 and interacting with and controlling the individual electronic gaming device 300.

Although FIG. 11 has an outline of a traditional gaming cabinet, the individual electronic gaming device 300 may be implemented in any number of ways, including, but not limited to, client software downloaded to a portable device, such as a smart phone, tablet, or laptop personal computer. The individual electronic gaming device 300 may also be a non-portable personal computer (e.g., a desktop or all-in-one computer) or other computing device. In some embodiments, client software is not downloaded but is native to the device or is otherwise delivered with the device when distributed to a player.

A communication device 360 may be included and operably coupled to the processor such that information related to operation of the individual electronic gaming device 300, information related to the game play, or combinations thereof may be communicated between the individual electronic gaming device 300 and other devices (not shown) through a suitable communication media, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown) and speakers (not shown) for transmitting and/or receiving sounds during game play. Further detail of an example of an individual electronic gaming device 300 (as well as other embodiments of tables and devices) is disclosed in U.S. patent application Ser. No. 13/215,156, filed Aug. 22, 2011, published as U.S. Patent Publication No. 2013/0053117 on Feb. 28, 2013, titled "Methods of Managing Play of Wagering Games and Systems for Managing Play of Wagering Games," the disclosure of which is incorporated herein in its entirety by this reference.

Some embodiments may be implemented at locations that include a plurality of player stations. Such player stations may include an electronic display screen for display of game information, such as displaying virtual cards, virtual chips, and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual cards, virtual chips, etc.), some features may remain in the physical domain. As such, the game play may be administered by a live dealer, a virtual dealer, or a combination of both.

Figure 12:
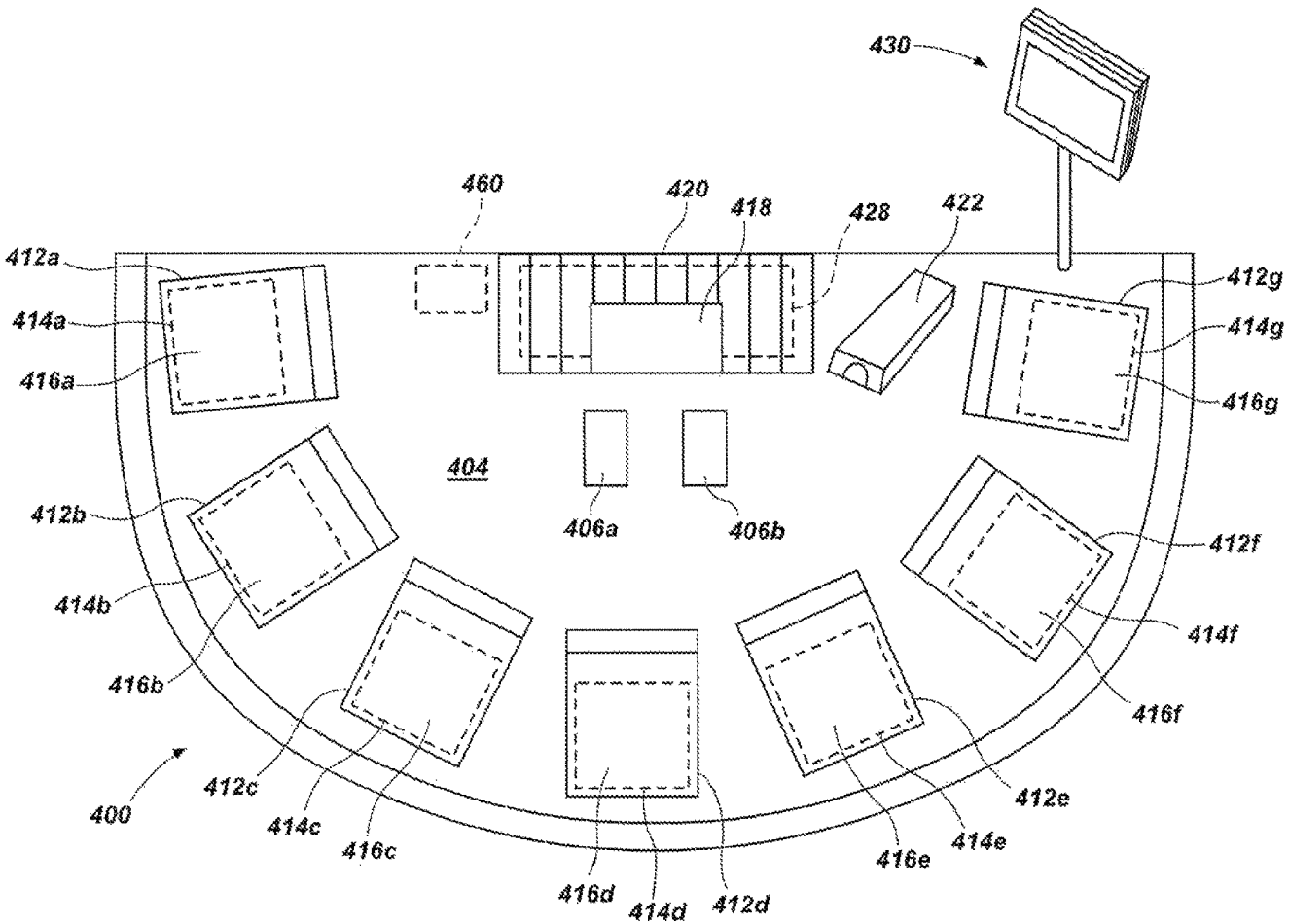
FIG. 12 is a top view of a table configured for implementation of embodiments of wagering games in accordance with this disclosure.

Referring to FIG. 12, an example of a suitable hybrid table 400 configured for implementation of embodiments of wagering games according to the present disclosure is shown. The table 400 may include a playing surface 404. The table 400 may include a plurality of player stations 412*a* through 412*g*. Each player station 412*a* through 412*g* may include an electronic player interface 416*a* through 416*g*, which may be used for displaying game information (e.g., game instructions, input options, wager information including virtual chips, game outcomes, etc.). The player interface 416*a* through 416*g* may include a display screen in the form of a touch screen, which may be at least substantially flush with the playing surface 404 in some embodiments. Each player interface 416*a* through 416*g* may be coupled respectively with its own local game processor 414*a* through 414*g* (shown in dashed lines); although, in some embodiments, a central game processor 428 (shown in dashed lines) may be employed and may communicate directly to player interfaces 416*a* through 416*g*. In some embodiments, a combination of individual local game processors 414*a* through 414*g* and the central game processor 428 may be employed.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices (not shown) through a suitable communication media, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using virtual chips. For hybrid systems using physical cards 406*a*, 406*b*, the table 400 may further include a card-handling device 422 that may be configured to shuffle (e.g., randomize), read, and deliver physical cards for the players to use during game play or, alternatively, a card shoe configured to read and deliver cards that have already been randomized. For embodiments using virtual cards, such virtual cards may be displayed at the individual player interfaces 416*a* through 416*g*. Common virtual cards may be displayed in a common card area (not shown).

The table 400 may further include a dealer interface 418, which, like the player interfaces 416*a* through 416*g*, may include touch screen controls for assisting the dealer in administering the wagering game. The table 400 may further include an upright display 430 configured to display images that depict game information such as pay tables, hand counts, historical win/loss information by player, and a wide variety of other information considered useful to the players. The upright display 430 may be double sided to provide such information to players as well as to the casino pit.

Further detail of an example of a hybrid table and player displays is disclosed in U.S. Patent Application Publication No. 2010/0016050, filed Jul. 15, 2008, published Jan. 21, 2010, now U.S. Pat. No. 8,262,475, issued Sep. 11, 2012, now titled "Chipless Table Split Screen Feature," the disclosure of each of which application and patent is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 13:
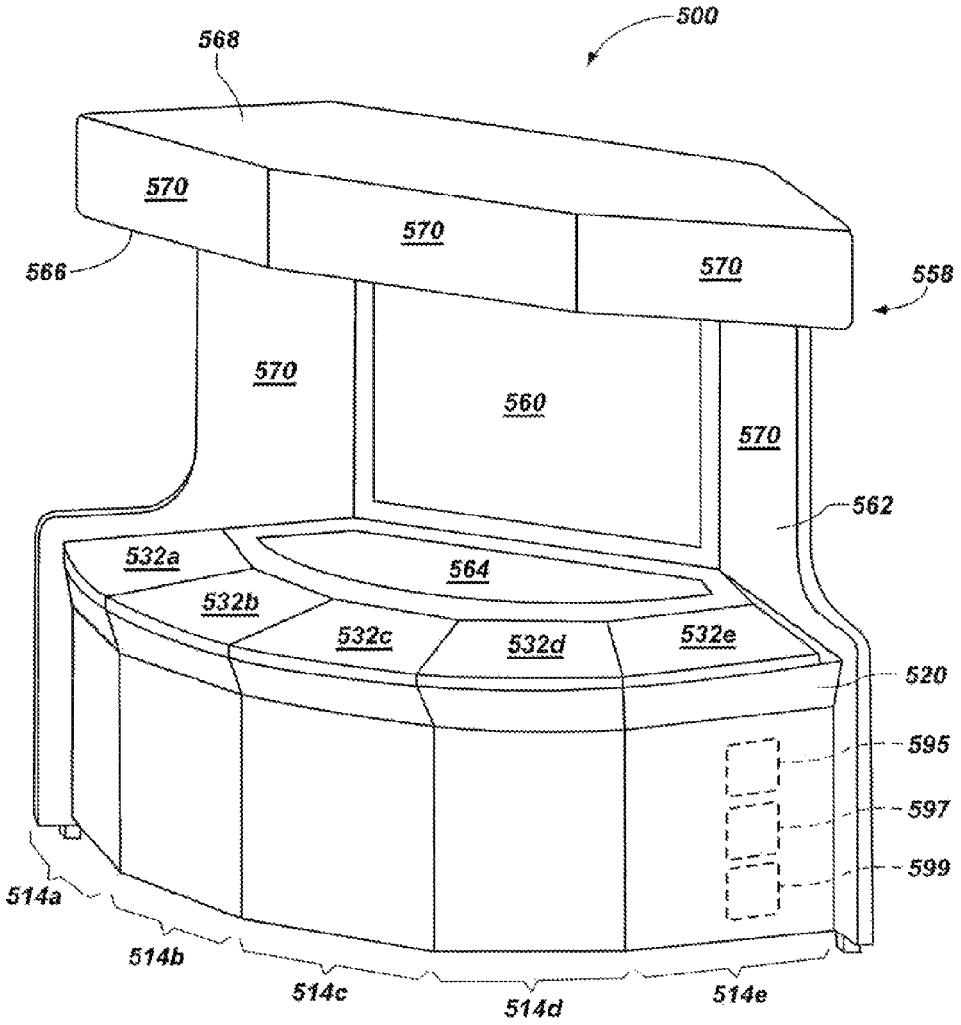
FIG. 13 is a perspective view of another embodiment of a table configured for implementation of embodiments of wagering games in accordance with this disclosure, wherein the implementation includes a virtual dealer.

Referring to FIG. 13, another example of a suitable table 500 configured for implementation of embodiments of wagering games and utilizing a virtual dealer according to the present disclosure is shown. The table 500 is fully electronic, and may include player positions 514*a* through 514*e* that are arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the virtual dealer's cards, community cards, and/or player's cards by the virtual dealer on the dealer screen 560 (virtual dealer not shown in FIG. 13).

Each of the player positions 514*a* through 514*e* may include a player interface area 532*a* through 532*e* that is configured for wagering and game play interactions with the video device 558 and/or virtual dealer. Accordingly, game play may be accommodated without involving physical playing cards, poker chips, and/or live personnel. The action may instead be simulated by a control processor 597 interacting with and controlling the video device 558. The control processor 597 may be located internally within, or otherwise proximate to, the video device 558. The control processor 597 may be programmed, by known techniques, to implement the rules of game play at the video device 558. As such, the control processor 597 may interact and communicate with display/input interfaces and data entry inputs for each player interface area 532*a* through 532*e* of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices (not shown) through a suitable communication media, such, as, for example, wired networks, Wi-Fi networks, and cellular communication networks.

The video device 558 may further include banners (not shown) configured to communicate rules of play and/or the like, which may be located along one or more walls 570 of the cabinet 562. The video device 558 may further include additional decorative lights (not shown) and speakers (not shown), which may be located on an underside surface 566, for example, of a generally horizontally depending top 568 of the cabinet 562 of the video device 558 generally extending toward the player positions 514*a* through 514*e*.

Further detail of an example of a table and player displays is disclosed in U.S. patent application Ser. No. 10/764,995, filed Jan. 26, 2004, published as U.S. Patent Application Publication No. 2005/0164762 on Jul. 28, 2005, now U.S. Pat. No. 8,272,958, issued Sep. 25, 2012, titled "Automated Multiplayer Game Table with Unique Image Feed of Dealer," the disclosure of each of which application and patent is incorporated herein in its entirety by this reference. Although an embodiment is described showing individual discrete player stations, in some embodiments, the entire playing surface (e.g., player interface areas 532*a* through 532*e*, card screen 564, etc.) may be an electronic display that is logically partitioned to permit game play from a plurality of players for receiving inputs from, and displaying game information to, the players, the dealer, or both.

As a specific, nonlimiting example, a gaming table for administering a wagering game may include a playing surface including at least one player interface for at least one player position and at least one processor. The at least one processor may be programmed to: receive an ante bet instruction for an ante bet designated to be resolved based at least in part on a first pay table; instruct the display of player card indicia for a player hand; engage in at least one post-dealing bet event for which the at least one processor is programmed to receive an election instruction selected from options including a fold instruction and a draw bet instruction for a draw bet to initiate the discard and replacement of a number of cards discarded from card indicia in the player hand at the initiation of the at least one post-dealing bet event, the number of cards selected between zero and a predefined limit that the at least one processor is programmed to decrease with each subsequent event of the at least one post-dealing bet event; and resolve all accepted bet instructions.

Figure 14:
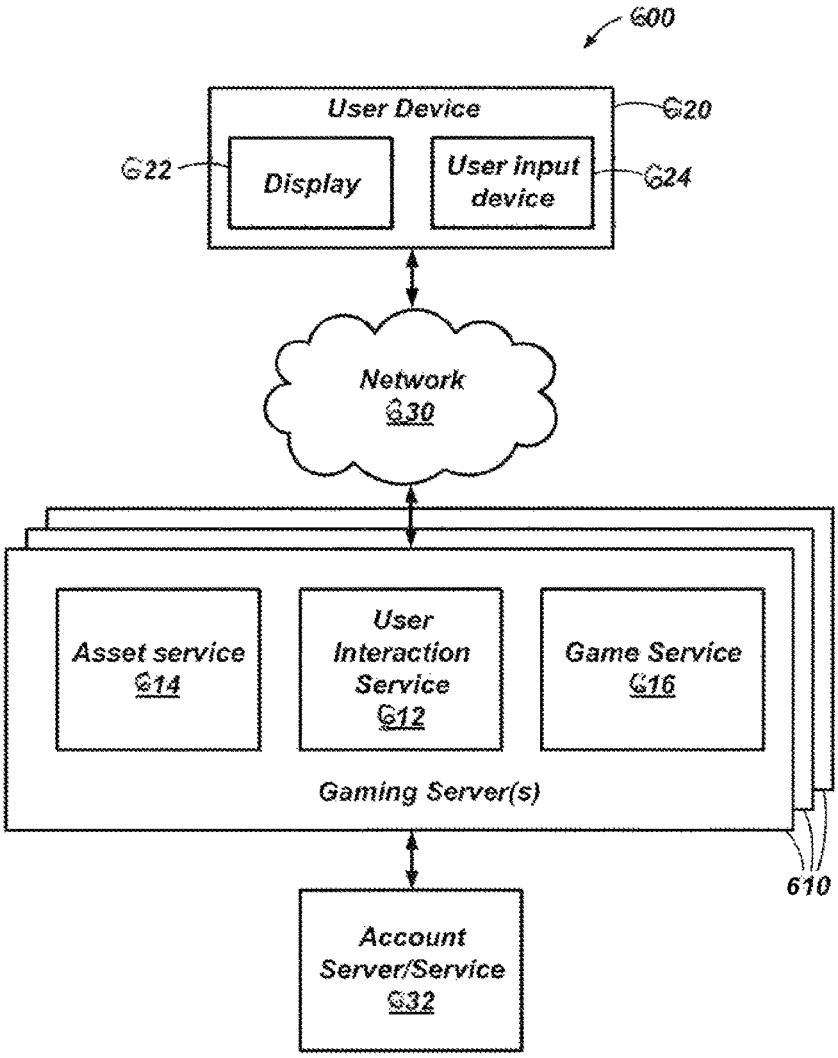
FIG. 14 is a schematic block diagram of a gaming system for implementing embodiments of waging games in accordance with this disclosure.

Wagering games in accordance with embodiments of the disclosure may be administered over the Internet, or otherwise online, in one embodiment using a gaming system employing a client server architecture. Referring to FIG. 14, illustrated is a schematic block diagram of a gaming system 600 for implementing wagering games according to an embodiment of the present disclosure. The gaming system 600 enables end users to access proprietary and/or non-proprietary game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not be limited to, Class II and Class III games as defined under 25 U.S.C. §2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform that establishes a portal for an end user to access a wagering game hosted by one or more gaming servers 610 through a user interaction service 612. The gaming system 600 enables players to interact with a user device 620 through a user input device 624 and a display 622 and to communicate with one or more gaming servers 610 using a network 630 (e.g., the Internet).

The gaming servers 610 may be configured as a single server including the functions for practicing embodiments of the present disclosure in combination with the user device 620. In other embodiments, the gaming servers 610 may be configured as separate servers for performing certain functions. Description herein concentrates on the multi-server embodiment illustrated in FIG. 14. However, a person of ordinary skill in the art will understand that the functions of various servers may be combined and separated into various different physical and virtual servers. As a result, this description also discusses "services" with the understanding that the various services may be performed by different servers or combinations of servers in different embodiments. As shown in FIG. 8, the gaming servers 610 may include a user interaction service 612, a game service 616, and an asset service 614. In some embodiments, one or more of the gaming servers 610 may communicate with an account server 632 performing an account service 632. As explained more fully below, for many wagering type games, the account service 632 may be separate and operated by a different entity than the gaming servers 610, however, in some embodiments the account service 632 may also be performed one or more of the gaming servers 610.

The user device 620 communicates with the user interaction service 612 through the network 630. The user interaction service 612 may communicate with the game service 616 and provide game information to the user device 620. In some embodiments, the game service 616 may also include a game engine. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616.

The user interaction service 612 may communicate with the user device 620 to enable access to the gaming system 600. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 can comprise a variety of implementations according to the user device 620 and method of communication with the gaming servers 610. In one embodiment, the user device 620 connects to the gaming servers 610 using a web browser, and the client executes within a browser window or frame of the web browser. In another embodiment, the client is a stand-alone executable on the user device 620.

In one embodiment, the client may comprise a relatively small amount of script (e.g., JAVASCRIPT®), also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." As that term is used herein, the client may be little more than a script player. The client may simply send requests to the gaming servers 610 rather than performing logic itself. The client receives player inputs, and the player inputs are passed to the gaming servers 610 for processing and executing the wagering game. In one embodiment, this includes providing specific graphical display information for the display 622 as well as game outcomes.

In other embodiments, the client comprises an executable file rather than a script. In that case, the client may do more local processing than does a script driver, such as calculating where to show what game symbols upon receiving a game outcome from the game service 616 through user interaction service 612. In one embodiment, it may be that portions of an asset service 614 are loaded onto the client and are used by the client in processing and updating graphical displays. Due to security and integrity concerns, most embodiments will have the bulk of the processing of the game play performed at the gaming servers 610. However, some embodiments may include significant game processing by client when the client and user device 620 are considered trustworthy or when there is reduced concern for security and integrity in the displayed game outcome. In most embodiments, it is expected that some form of data protection, such as end-to-end encryption, will be used when data is transported over the network 630. The network 630 may be any network, including, but not limited to, the Internet.

In an embodiment where the client implements further logic and game control methodology beyond the thin client, the client may parse and define player interactions prior to passing the player interactions to the gaming servers 610. Likewise, when the client receives a gaming interaction from the gaming servers 610, the client may be configured to determine how to modify the display as a result of the gaming interaction. The client may also allow the player to change a perspective or otherwise interact with elements of the display that do not change aspects of the game.

The gaming servers 610 may include an asset service 614, which may host various media assets (e.g., audio, video, and image files) that may be sent to the user device 620 for presenting the various wagering games to the end user. In other words, in this embodiment, the assets presented to the end user may be stored separately from the user device 620. In one embodiment, the user device 620 requests the assets appropriate for the game played by the user; in other embodiments, especially those using thin clients, just those assets that are needed for a particular display event will be sent by the gaming servers 610 when the game service 616 determines they are needed, including as few as one asset. In one example, the user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 or to different games to be played.

The gaming servers 610 may include the game service 616, which may be configured to perform game play methods and determine game play outcomes that are provided to the user interaction service 612 to be transmitted to the user device 620 for display. For example, the game service 616 may include game rules for one or more wagering games, such that the game service 616 controls some or all of the game flow for a selected wagering game as well as the determined game outcomes. The game service 616 may include pay tables and other game logic. The game service 616 also performs random number generation for determining random game elements of the wagering game. In one embodiment, the game service 616 is separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. As such, the user device 620 can be a desktop computer, a laptop, a tablet computer, a set-top box, a mobile device (including, but not limited to, a smart phone), a kiosk, a terminal, or another computing device. The user device 620 operating the client may comprise an interactive electronic gaming system 300 (see FIG. 11), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface)

indicating that the client is embedded into a webpage, which is supported by a web browser executing on the user device 620.

In one embodiment, the gaming system 600 may be operated by different entities. The user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In another embodiment, the user interaction service 612 and asset service 614 are provided by a third-party system. For example, a gaming entity (e.g., a casino) may operate the user interaction service 612, user device 620, or combination thereof to provide its customers access to game content managed by a different entity that may control the game service 616, amongst other functionality. In some embodiments, these functions are operated by the same administrator. For example, a gaming entity (e.g., a casino) may elect to perform each of these functions in-house, such as providing both the access to the user device 620 and the actual game content and providing administration of the gaming system 600.

The gaming servers 610 may communicate with one or more external account servers 632 (also referred to herein as an account server 632), optionally through another firewall. For example, the gaming servers 610 may not directly accept wagers or issue payouts. That is, the gaming servers 610 may facilitate online casino gaming but may not be part of a self-contained online casino itself. Instead, the gaming servers 610 may facilitate the play of wagering games owned and controlled by a company offering games and gaming products and services, such as SHFL entertainment, Inc. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits.

In some embodiments, the gaming servers 610 may directly accept bets and make payout distributions, such as in the case where an administrator of the gaming servers 610 operates as a casino. As discussed above, the gaming servers 610 may be integrated within the operations of a casino rather than separating out functionality (e.g., game content, game play, credits, debits, etc.) among different entities. In addition, for play-for-fun wagering games, the gaming servers 610 may issue credits, take bets, and manage the balance of the credits according to the game outcomes, but the gaming servers 610 may not permit payout distributions or be linked to an account service 632 that permits payout distributions. Such credits may be issued for free, through purchase, or for other reasons, without the ability for the player to cash out. Such play-for-fun wagering games may be administered on platforms that do not permit traditional gambling, such as to comply with jurisdictions that do not permit online gambling.

The gaming servers 610 may be configured in many ways ranging, without limitation, from a fully integrated single system to a distributed server architecture. The asset service 614, the user interaction service 612, the game service 616, and the account service 632 may be configured as a single, integrated system of code modules running on a single server 610 or machine, where each of the service is functionally implemented on a single machine. In such a case, the functionality described herein may not be implemented as separate code modules. The asset service, the user interaction service 612, the game service 616, and the account service 632 may also be implemented as a plurality of independent servers, each using its own code modules running on a separate physical machine, and may further include one or more firewalls between selected servers (depending on security needs). Each server may communicate over some kind of networked connection, potentially as varied as that described for network 630. Further, each single server shown in FIG. 14 may be implemented as a plurality of servers with load balancing and scalability factors built into the embodiment. All such embodiments and variations are fully contemplated.

Additional features may be supported by the gaming servers 610, such as hacking and cheating detection, data storage and archival, metrics generation, messages generation, output formatting for different end user devices, as well as other features and operations. For example, the gaming servers 610 may include additional features and configurations as described in U.S. patent application Ser. No. 13/353,194, filed Jan. 18, 2012, and application Ser. No. 13/609,031, filed Sep. 10, 2012, both applications titled "Network Gaming Architecture, Gaming Systems, and Related Methods," the disclosures of which are incorporated herein in their entirety by this reference.

The network 630 may enable communications between the user device 620 and the gaming servers 610. A network (not shown) may also connect the gaming servers 610 and account server 632, and, further, one or more networks (not shown), which may be a secure network, may also connect the gaming servers 610 and the account server 632. Thus, the network 630 can include links using technologies such as Ethernet, 802.11, worldwide interoperability for microwave access (WIMAX®), 3G, digital subscriber line (DSL), asynchronous transfer mode (ATM), INFINIBAND®, PCI Express Advanced Switching, etc. Similarly, the networking protocols used on the network 630 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 630 can be represented using technologies and/or formats including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc.

In another embodiment, the entities can use custom or dedicated data communications technologies instead of, or in addition to, the ones described above. Depending upon the embodiment, the network 630 can include links comprising one or more networks such as the Internet.

Figure 15:
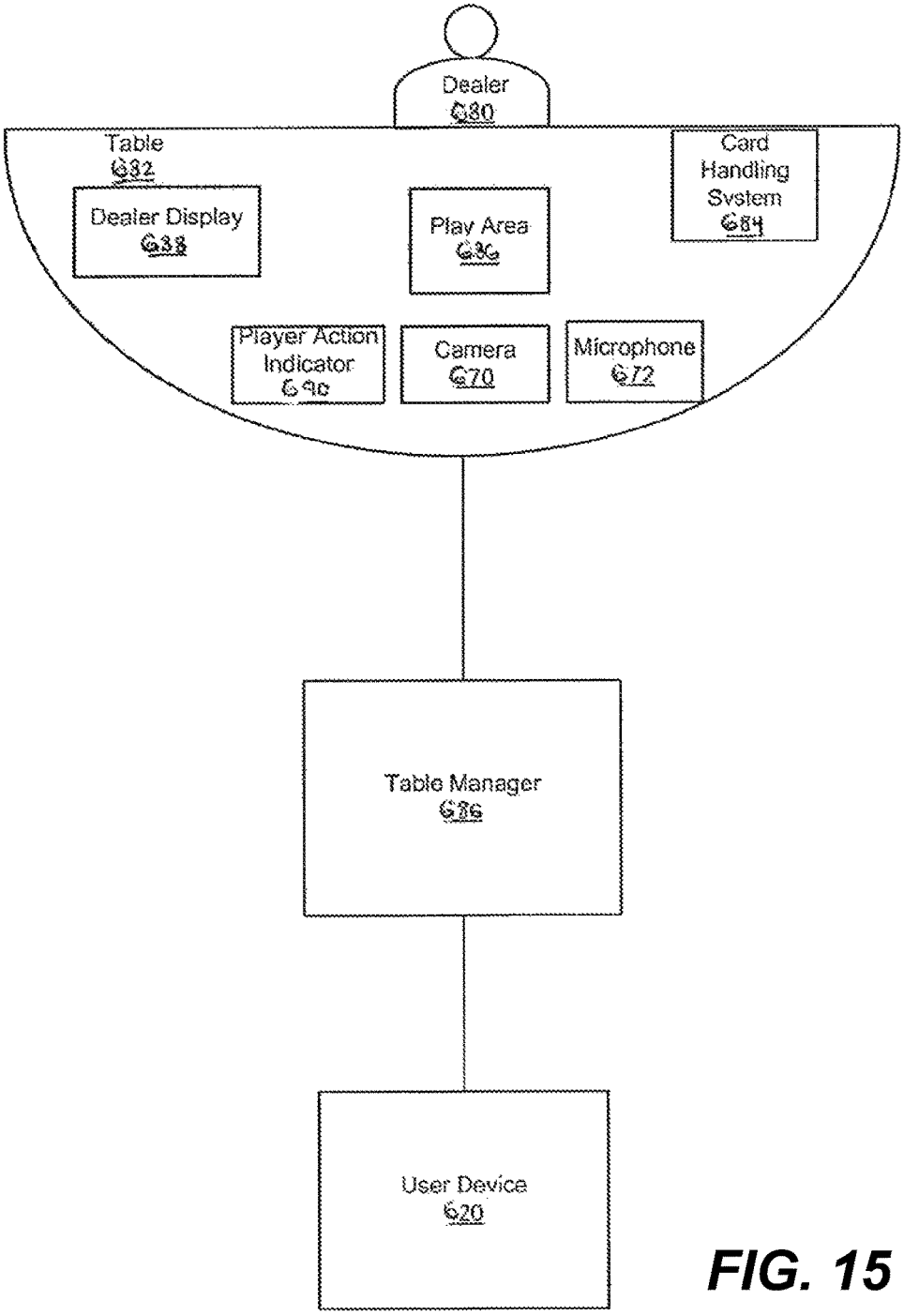
FIG. 15 is a schematic block diagram of a gaming system for implementing embodiments of wagering games including a live dealer feed.

Referring to FIG. 15, a schematic block diagram of an embodiment of a table 682 for implementing embodiments of wagering games including a live dealer feed is shown. Features of the gaming system 600 (see FIG. 14) described above in connection with FIG. 14 are generally utilized in connection with this embodiment, except as further described. In this embodiment, rather than cards being determined by a computerized random process, physical cards (e.g., from a standard, 52-card deck of playing cards) are dealt by a dealer 680 at a table 682 from a card handling system 684. A table manager 686 assists the dealer 680 in facilitating play of the game by transmitting a video feed of the dealer's actions to the user device 620 and transmitting player elections to the dealer 680. As described above, the table manager 686 may act as or communicate with a gaming system 600 (see FIG. 8) (e.g., acting as the gaming system 600 (see FIG. 14) itself or as an intermediate client interposed between and operationally connected to the user device 620 and the gaming system 600 (see FIG. 14)) to provide gaming at the table 682 to users of the gaming system 600 (see FIG. 14). Thus, the table manager 686 communicates with the user device 620 through a network 630 (see FIG. 14), and may be a part of a larger online casino, or may be operated as a separate system that facilitates game play. In various embodiments, each table 682 is managed by an individual table manager 686 constituting a gaming device, which receives and processes information relating to that table. For simplicity of description, these functions are described as being performed by the table manager 686, though certain functions may be performed by an intermediary gaming system 600 (see FIG. 14), such as the one shown and described in connection with FIG. 14. In some embodiments, the gaming system 600 (see FIG. 14) may match remotely located players to tables 682 and facilitate transfer of information between user devices 620 and tables 682, such as wagering amounts and player option elections, but does not manage gameplay at individual tables. In other embodiments, functions of the table manager 686 are incorporated into a gaming system 600 (see FIG. 14).

The table 682 includes a camera 670 and optionally a microphone 672 that capture video and audio feeds relating to the table 682. The camera 670 is trained on the dealer 680, play area 686, and card handling system 684. As the game is administered by the dealer 680, the player using the user device 620 is shown the video feed captured by the camera 670, and any audio captured by the microphone 672 is played to the player using the user device 620.

The card handling system 684 is typically a shuffling device, though the card handling system 684 may also be a shoe or a shuffler-and-shoe combination device for dispensing cards. When the game play rules require cards to be dealt, the dealer 680 obtains the cards from the card handling system 684 and places the cards in the appropriate location in a play area 686. The play area 686 depicts player positions and any applicable card locations for playing the game, such as shown in FIGS. 1 through 5. As determined by the rules of the game, the player at the user device 620 may be presented options for responding to an event in the game using a client as described with reference to FIG. 14.

The user device 620 presents the options to the player and permits the player to select an election from among the options. The election is transmitted to the table manager 686, which provides player elections to the dealer 680 using a dealer display 688 and player action indicator 690 on the table 682. The dealer display 688 and player action indicator 690 provide information to the dealer 680 regarding the game play and elections made by players. Using the dealer display 688, for example, the dealer 680 may obtain information regarding where to deal the next card, or which player position is responsible for the next action.

In one embodiment, the table manager 686 receives card information from the card handling system 684 identifying cards dealt by the card handling system 684. The card handling system 684 may include a card reader that determines card information from the card. For example, the card handling system 684 may process an image of the card, or the card handling system 684 may include a barcode reader or other system for obtaining information regarding each card. The card information may include rank and suit of each dealt card, which is obtained by the card handling system 684 and transmitted to the table manager 686. The card handling system 684 may also dispense more than one card at once, or identify a set of cards dispensed together as a hand. An illustrative card handling system 684 is described in U.S. Pat. No. 8,070,574, the disclosure of which is incorporated in this application in its entirety by this reference.

Using the card information, the table manager 686 identifies hands associated with each player. The table manager 686 uses the card information and identified hands, along with the elected player decisions, to determine gameplay events and, using the rules of the game, determine wager results. Alternatively, the wager results are determined by the dealer 680 and input to the table manager 686, and may be used to confirm automatically determined results by the gaming system. Optionally, the card information relating to cards viewable by a player is also transmitted to the user device 620 associated with the player, permitting representations of the cards to be displayed to the user in addition to the cards viewed in the play area 686.

In some embodiments, the card handling system 684 is a table-mounted card reader that reads cards that are manually passed over the reader. When a game is hand pitched, it is desirable to provide a card reader to automatically obtain rank and suit data for use by the table manager 686.

In embodiments, the camera 670 is trained to capture images of the card faces, chips and chip stacks that are present on the surface of the gaming table. Known image extraction techniques may be used to obtain card count and card rank and suit information from the card images. An example of suitable image extraction software can be found in U.S. Pat. No. 7,901,285. The content of this patent is incorporated by reference in its entirety.

Card and wager data in some embodiments is used by the table manger 686 to determine game outcome. The data extracted from the camera 670 may be used to confirm the card data obtained from the card handling system 684, to determine a player position that received a card, and for general security monitoring purposes, such as detecting player or dealer card switching, for example.

The live video feed permits the dealer to show cards dealt by the card handling system and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

Figure 16:
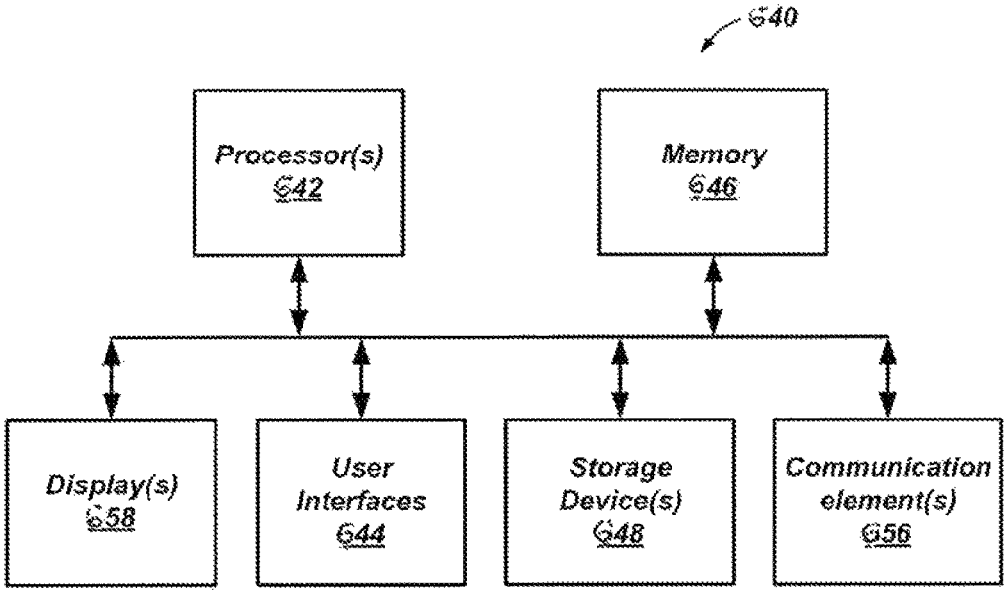
FIG. 16 is a block diagram of a computer for acting as a gaming system for implementing embodiments of wagering games in accordance with this disclosure.

FIG. 16 is a simplified block diagram showing elements of computing devices that may be used in embodiments of the present disclosure. The computing system 640 may be a user-type computer, a file server, a compute server, a notebook computer, a tablet, a handheld device, a mobile device, or other similar computer system for executing software. Computer, computing system, mobile device, and server may be used interchangeably herein to indicate a system that might practice a portion or all of the processes of the present disclosure. The computing system 640 is configured for executing software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured for executing a wide variety of operating systems and applications including the computing instructions for carrying out embodiments of the present disclosure.

The memory 646 may be used to hold computing instructions, data, and other information for performing a wide variety of tasks including performing embodiments of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 648 may be used for storing relatively large amounts of non-volatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

FIG. 16 is intended for discussing a simplified versions of a computing system 640. A person of ordinary skill in the art will recognize that the computing system 640 may be configured in many different ways with different types of interconnecting busses between the various elements. Moreover, the various elements may be subdivided physically, functionally, or a combination thereof. As one non-limiting example, the memory 646 may be divided into cache memory, graphics memory and main memory. Each of these memories may communicate directly or indirectly with the one or more processors 642 on separate busses, partially-combined busses, or a common bus.

The one or more processors 642 may also be referred to herein as processing circuitry. As a non-limiting example, when implemented as custom circuitry, the processing circuitry can be configured for carrying out embodiments of the present disclosure. As another non-limiting example, the processing circuitry may include memory 646 for holding computing instructions and one or more processors 642 for executing the computing instructions.

Software processes described herein are intended to illustrate representative processes that may be performed by the systems described herein. Unless specified otherwise, the order in which the process acts are described is not intended to be construed as a limitation, and acts that may be described as occurring sequentially for ease of description may occur in a different sequence, occur concurrently, occur concurrently on multiple hardware platforms, or occur in one or more parallel process streams. It will be appreciated by those of ordinary skill in the art that many acts and processes may occur in addition to those outlined in flow charts. Furthermore, the processes may be implemented in any suitable hardware, software, firmware, or combinations thereof. When executed as firmware or software, the instructions for performing the processes may be stored on a computer-readable medium and hardware executing the processes should be considered as special purpose hardware configured for carrying out processes described herein.

By way of non-limiting example, computing instructions for performing the processes may be stored on the storage 648, transferred to the memory 646 for execution, and executed by the processors 642. The processors 642, when executing computing instructions configured for performing the processes, constitutes structure for performing the processes and can be considered as a special-purpose computer when so configured. In addition, some or all portions of the processes may be performed by hardware specifically configured for carrying out the processes.

In addition, some or all of the components of this general computing system 640 of FIG. 16 may be used as part of the processor and memory discussed above with respect to the systems of FIGS. 6 through 8 and 10 through 15.

The gaming system 600 (FIG. 14) may comprise several such computing systems 640. The gaming system 600 may include load balancers, firewalls, and various other components for assisting the gaming system 600 to provide services to a variety of user devices.

As is known in the art, the computing system 640 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 648, loaded into the memory 646, and executed by the processor 642.

Embodiments of the entities described herein can include other different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product that can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

In some embodiments, wagering games may be administered over a network in a house-banked format. For example, at least one processor may receive, over the network, an ante bet instruction input at a user device in communication with the at least one processor. The ante bet instruction is for an ante bet designated to be resolved based at least in part on a first pay table. The at least one processor may instruct, over the network, the user device to display player card indicia for a player hand. Absent prior receipt of a fold instruction, the at least one processor may engage the user device in at least one post-dealing bet event. The at least one post-dealing bet event comprises the at least one processor receiving, over the network, an election instruction input at the user device. The election instruction is selected by the player at the user device from options including the fold instruction and a draw bet instruction for a draw bet. The draw bet instruction would initiate the at least one processor to receive, over the network, a discard instruction designating a number of cards to be discarded from card indicia in the player hand at the initiation of the at least one post-dealing bet event, the number of cards selected at the user device between zero and a predefined limit that the at least one processor is programmed to decrease with each subsequent event of the at least one post-dealing bet event. The draw bet instruction would also initiate, e.g., after the at least one processor receives the discard instruction, the at least one processor to instruct, over the network, the user device to display to the player other card indicia for replacement cards equaling the number of cards selected at the user device. The at least one processor resolves all accepted bet instructions.

As another example, a method according to an embodiment of the present disclosure may include administering a wagering game implemented on an interactive gaming system. The method may comprise providing an interactive gaming system comprising a table attended by a live dealer and a video feed of the table and the live dealer communicated to a user device via a table manager programmed to relay instructions received from the user device to the live dealer. A standard 52-card deck of physical playing cards and two physical joker cards, randomized with the standard 52-card deck, may be provided at or proximate to the table to form a 54-card deck of physical playing cards. An ante bet instruction, for an ante bet of an ante bet amount, is received. A bonus bet instruction, for a bonus bet of a bonus bet amount, is also received. The table manager is caused to communicate, to the user device, video of the live dealer distributing, on a surface of the table and from the 54-card deck of physical playing cards, an initial five physical playing cards for a player hand associated with a user of the user device. An election instruction is received from the user device via the table manager. The election instruction is selected between a fold instruction, and a first draw bet instruction for a first draw bet of a first draw bet amount. After receiving, from the user device via the table manager, the first draw bet instruction when the first draw bet instruction is selected between the fold instruction and the first draw bet instruction, a first draw number of cards is received from the user device via the table manager. The first draw number of cards is selected from the initial five physical playing cards, and the first draw number is selected between zero and three cards. The table manager is caused to communicate, to the user device, video of the live dealer distributing, on the surface of the table and from the 54-card deck of physical playing cards, a number of additional cards equaling the first draw number to form an interim five card hand. Another election instruction is received from the user device via the table manager. The another election instruction is selected between another fold instruction and a second draw bet instruction for a second draw bet of a second draw bet amount. After receiving, from the user device via the table manager, the second draw bet instruction when the second draw bet instruction is selected between the another fold instruction and the second draw bet instruction, a second draw number of cards is received from the user device via the table manager. The second draw number of cards is selected from the interim five card hand, and the second draw number is selected between zero and one cards. The table manager is caused to communicate, to the user device, video of the live dealer distributing, on the surface of the table and from the 54-card deck of physical playing cards, a number of final cards equaling the second draw number to form a final five card hand. The ante bet and all received draw bets of the first draw bet and the second draw bet are resolved according to a first payout table. The bonus bet is resolved according to a second payout table.

In some embodiments, wagering games may be administered over a network in an at least partially player-pooled format, with payouts on pooled wagers being paid from a pot and losses on wagers being collected into the pot and eventually distributed to one or more players. Such player-pooled embodiments may include a player-pooled progressive embodiment, in which a pot is eventually distributed when a predetermined progressive-winning hand combination or composition is dealt. Player-pooled embodiments may also include a dividend refund embodiment, in which at least a portion of the pot is eventually distributed in the form of a refund distributed, e.g., pro-rata, to the players who contributed to the pot.

In some player-pooled embodiments, due to regulatory constraints, the game administrator may not obtain profits from chance-based events occurring in the wagering games that result in lost wagers. Instead, lost wagers may be redistributed back to the players, which may enable the wagering games to qualify as nonbanked games (e.g., under Class II of the Indian Gaming Regulatory Act). Accordingly, the wagering games may be offered over the Internet as online poker in some jurisdictions. To profit from the wagering game, the game administrator may retain a commission, such as, for example, a player entrance fee or a rake taken on wagers, such that the amount obtained by the game administrator in exchange for hosting the wagering game is limited to the commission and is not based on the chance events occurring in the wagering game itself. Specific, illustrative mechanisms for redistributing the lost wagers back to players are described in connection with FIGS. 17 and 18.

Figure 17:
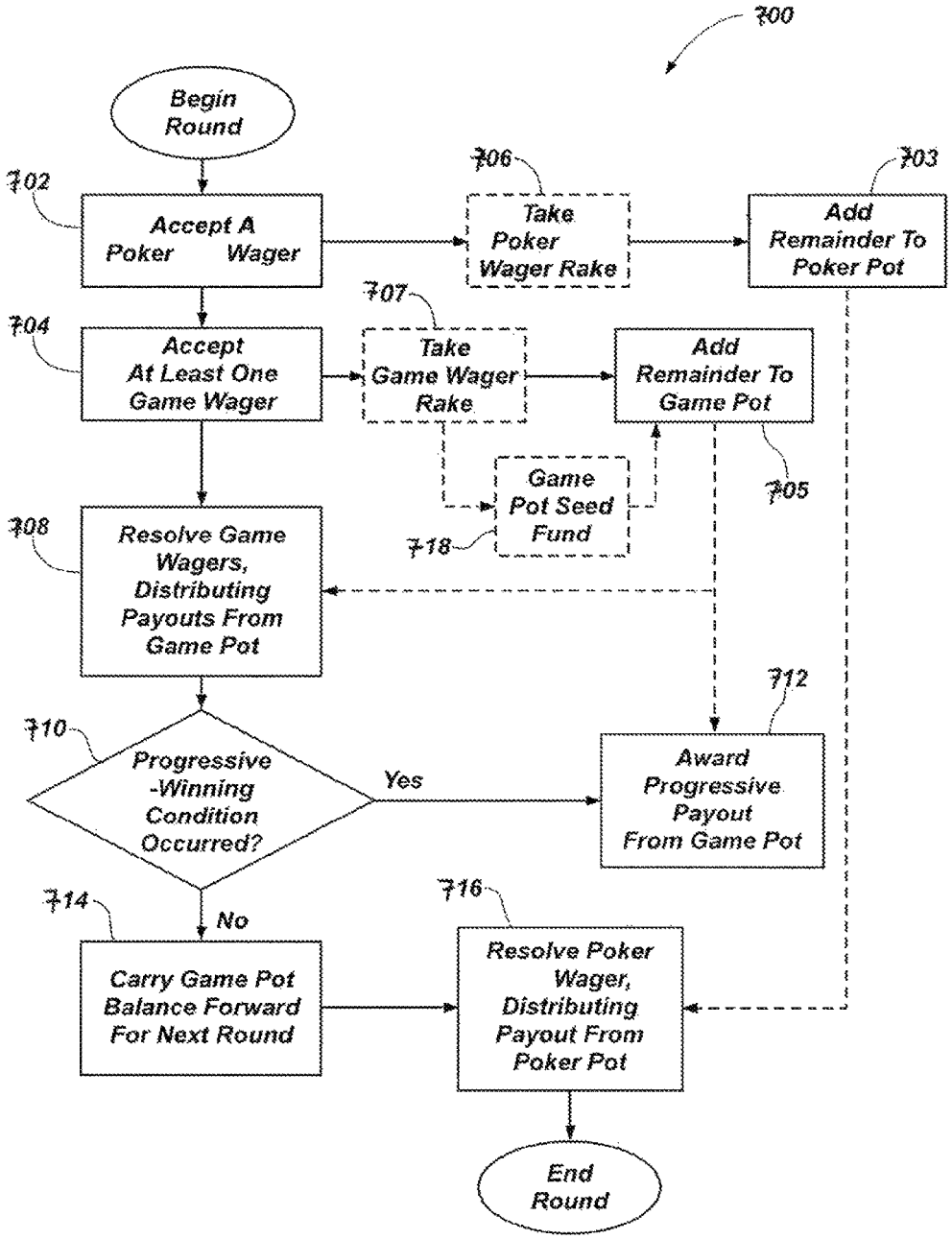
FIG. 17 is a flowchart diagram of a method of administering a wagering game, which may be at least partially player-pooled, according to a player-pooled progressive embodiment.

Referring to FIG. 17, shown is a flowchart diagram of a method 700 of administering a wagering game, which may be at least partially player-pooled, according to a player-pooled progressive embodiment. The method 700 includes accepting a first mandatory wager, referred to herein as a "poker wager," as indicated at operation 702. At least a portion of the poker wager is added to a poker pot, as indicated at operation 703. The poker wager may be later resolved by comparing player hands and awarding the poker pot, or at least a portion thereof, to the player holding a highest five-card hand among the five-card player hands of the round. For example, if one player holds a royal flush that outranks all other players' hands, the royal-flush-holding player may be awarded all or a portion of the poker pot.

The poker pot may be a non-progressive pot in that all or substantially all of the poker pot may be distributed at the conclusion of each round of administration of the wagering game. In some embodiments, the poker wager may be a mandatory wager to qualify the player for play of the underlying wagering game. In other embodiments, the poker wager may be optional, and the wagering game may be administered to a player without receiving the poker wager and without qualifying the player for a potential payout from the poker pot.

The dealer may also accept at least one game wager, as indicated at operation 704. The game wagers may include, for example, a base game wager (e.g., ante wagers, bonus wagers, draw wagers, and other wagers made on the underlying wagering game) and/or a side or bonus wager. More specifically, the game wagers may comprise, for example, the ante bet, the bonus bet, the first draw bet, and the second draw bet, discussed above in connection with FIGS. 1 through 9B. The at least one game wager may be accepted, for example, by performing any of the acts described previously in connection with FIGS. 1 through 9B. At least a portion of the at least one game wager is added to a game pot, as indicated at operation 705, which game pot may be a progressive pot.

Optionally, a third pot wager may be accepted and added to at least a third pot. The third pot may be separate from either or both of the poker pot and the game pot. For example, the poker pot, the game pot, and the third pot may be displayed as separate amounts on one or more video displays 374, 404, 414, 418, 430, 532, 560, 564, and 658 (see FIGS. 11 through 15) (e.g., a monitor) controlled by one or more processors 350, 414, 428, 597, and 642 (see FIGS. 11 through 15) and may be maintained in separate accounts when the wagering game is conducted online or in another electronic format.

In some embodiments, acceptance of the at least one game wager qualifies a player to be eligible to win an award in addition to the payouts available from the underlying game (i.e., payouts on the ante bet, the bonus bet, and the draw bets), such as, for example, a progressive payout (e.g., a progressive jackpot awarded to one or more qualifying players). Therefore, in some such embodiments, a progressive wager may be received, in addition to the other game wagers received from the player, such as the ante bet, the bonus bet, and the first and second draw bets. In other such embodiments, one of the game wagers may be converted to a progressive wager, such as, for example, the bonus bet. In some embodiments, the progressive wager may be a mandatory wager to qualify the player for play of the underlying wagering game. In other embodiments, the progressive wager may be optional, and the wagering game may be administered to a player without receiving the progressive wager, in addition to any other game wagers, from the player and without qualifying the player to be eligible to win the progressive payout from the game pot.

In some embodiments, the poker wager and the at least one game wager may be received as indistinct wagers, with a portion thereof being designated for the poker pot (a non-progressive pot) and another portion being designated for the game pot (a progressive pot).

The poker wager and the at least one game wager (including the progressive wager, depending on the embodiment) may be accepted, for example, by performing any of the acts described previously for accepting wagers in connection with FIGS. 1 through 9B.

In some embodiments, the game pot may be a pooled or linked pot. For example, the game pot may include one or more game wagers accepted from multiple concurrent wagering games. As another example, the game pot may include pooled progressive wagers from those wagering games currently being played and/or may include accumulated game wagers from past wagering games. As specific, nonlimiting examples, the game pot may include all game wagers accepted from a group of electronic gaming tables or other local wagering game administration devices at a casino, from multiple groups of remote devices connected to network gaming architecture, or both. In other embodiments, the game pot may not be pooled, and awards for the game wager may be limited to the amounts wagered at a respective electronic gaming table, other local wagering game administration device, or group of remote devices.

The gaming establishment (e.g., the "house") may take a "rake" (e.g., a commission for the house) on at least one wager, such as the poker wager, as indicated at operation 706, the at least one game wager, as indicated at operation 707, or both. In some embodiments, therefore, a rake may be taken on all wagers, or any wager. For example, the house may collect a portion of the poker wager at the time the poker wager is placed. Additionally or alternatively, the house may collect a portion of the game wagers at the time the game wagers are placed.

The rake may comprise, for example, a fixed percentage of the wagers. More specifically, the percentage of the wagers collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last 5, 10, or 15 years for a given casino or other gaming establishment). As specific, nonlimiting examples, the percentage of the wagers (i.e., either or both of the poker wager and the at least one game wager) collected for the rake may be between 3% and 8%, between 4% and 7%, or between 5% and 6%. In other embodiments, the portion of the wagers collected for the rake may comprise a variable percentage of the wagers or may comprise a fixed quantity (e.g., a flat fee) irrespective of the total amount for the wagers, a fixed percentage with a cap, or a time-based fee for increments of time playing the wagering game. Thus, in lieu of, or in addition to, a rake taken on one or more wagers, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission."

All profits for the house may be made from the rake (or rakes or other commission) in some player-banked embodiments. In such embodiments, wagered amounts in excess of the rake are distributed either in the form of, for example, a progressive payout (as in a "player-pooled progressive" embodiment (FIG. 17)), a dividend refund (as in a "dividend refund" embodiment (FIG. 18)), or some combination thereof. Thus, the profits for the house are limited. Such limiting of profits for the house and redistribution of wagers back to one or more players may increase the attractiveness of the wagering game to both inexperienced and highly skilled players. Because the amount earned by the house is known, highly skilled players may perceive that their skill will enable them to increase winnings, and inexperienced players may be enticed by the possibility of winning or otherwise earning a portion or all of one or more of the pots. In other embodiments, the house may make profits on the rake and on losses from one or more of the wagers (e.g., the ante bet, the bonus bet, the first draw bet, the second draw bet), including losses resulting from optimal and suboptimal play.

The rake may be maintained in a rake account, and profits for the house may be deducted from the rake account. When and if taken from the poker wagers, the poker wager rake (operation 706) may be taken by, for example, electronically transferring funds from the poker wagers to a poker pot rake account (e.g., as instructed by a game service 616 (see FIG. 14) using casino account servers 632 (see FIG. 14)). Likewise, when and if taken from the game wagers, the game wager rake (operation 707) may be taken by, e.g., electronically transferring funds from the game pot wagers to a game pot rake account (e.g., as instructed by the game service 616 (see FIG. 14) using casino account servers 632 (see FIG. 14)).

In some embodiments, the poker wager may be accepted (operation 702) at the beginning of a round of administration of the wagering game. One or more of the game wagers may be accepted (operation 704) at the beginning of the round as well, e.g., the ante bet and the bonus bet. In some embodiments, additional game wagers may be accepted (operation 704), possibly raked (operation 707), and added to the game pot (operation 705) in the intermediate segments of the round of play, e.g., the first draw bet and the second draw bet.

The underlying wagering game may be played as described above, including resolving the game wagers received during the round of play, as indicated at operation 708. For example, the underlying wagering game may be played at least substantially as described previously in connection with FIGS. 1 through 9B. Payouts to be distributed, as a result of resolving the game wagers, (e.g., the ante bet, the bonus bet, the first draw bet, and the second draw bet), are paid from the game pot.

It is contemplated that only a portion of the game pot may be distributed, at operation 706, in the form of payouts on the underlying game. At least in embodiments in which the game pot is configured as a progressive pot (e.g., if one of the game wagers is a progressive wager), all or substantially all of the remaining portion of the game pot may be designated for a potential progressive payout. For example, administering the player-pooled progressive embodiment of the player-pooled wagering game may include determining whether a progressive-winning condition has occurred, as indicated at operation 710. A progressive-winning condition may be predefined as a predetermined winning hand combination being dealt or a premium winning hand composition being dealt. If such a progressive-winning condition has occurred during the round of game administration, a progressive payout may be awarded to the winning-hand-holding player, with the progressive payout being paid from the game pot, as indicated at operation 712. As just one example, a game may pay a progressive payout for a five-card royal flush. If no progressive-winning condition has occurred, a progressive payout may not be paid from the game pot, but, rather, the game pot balance may be carried forward for the next round of play and so on, as indicated at operation 714, until a progressive-winning condition occurs during a subsequent round. Thus, the game pot may not be awarded at the end of each round of play, but may grow during each successive round in which no player is dealt a predetermined winning hand combination or a premium winning hand composition. However, if the underlying game payouts distributed at operation 708, or if a progressive payout is awarded at operation 712, without draining the game pot, the game pot may decrement until the game pot contributions, at operation 705, rebuild the game pot.

A predetermined winning hand combination may comprise, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until it is determined that at least one player hand achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may comprise, for example, a four-of-a-kind, a straight flush, or a royal flush. The hand compositions qualifying as premium winning hand compositions may remain fixed throughout the duration of the wagering game or may change during the wagering game. For example, after it has been determined that a player hand has achieved a premium winning hand composition, the hand compositions qualifying as premium winning hand compositions may be made more restrictive or less restrictive. As a specific, nonlimiting example, after identification of a player hand achieving a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the game pot is a progressive pot, the amount awarded from the game pot for achieving a premium winning hand composition may be a progressive payout at least as great as a maximum progressive payout for achieving a predetermined winning hand composition. For example, the entire game pot may be awarded when a player or multiple players are dealt a premium winning hand composition, and only a portion of the game pot may be awarded when a player or multiple players are dealt a predetermined winning hand combination.

Awarding the game pot or a portion of the game pot may comprise crediting a player account with funds from the game pot or may comprise distributing physical money or physical representations of money from the game pot to the player.

Before, between, or after resolving the game wagers (operation 708), determining whether a progressive-winning condition occurred (operation 710), awarding a progressive payout (operation 712), or any combination thereof, the poker wager may be resolved, and the poker pot may be awarded to at least one player, as indicated at operation 716. Each successive round of receiving wagers, dealing cards, and resolving wagers may constitute a round of play, and the poker pot may be awarded to at least one player before the end of each round of play. The player to whom the poker pot is awarded may hold a five-card royal flush when compared to the hands of other players at the virtual "table."

Awarding the poker pot or the portion of the poker pot may comprise crediting a player account of each winning player or may comprise distributing physical money or physical representations of money to each winning player.

In some embodiments, an entire amount of the poker pot may be awarded to at least one player before the end of each round of play. In such embodiments, the poker pot may be a non-progressive pot. Awarding the entire poker pot to at least one player at the end of each round of play may enable an online implementation of the wagering game to qualify as a legal form of online gambling under relevant statutes. For example, games that require a mandatory pot bet that has no house advantage, and all other game wagers are raked and then allocated to a second pot, may qualify as "poker" to gaming authorities, especially for online versions of the games. Awarding the entire amount of a poker pot to at least one player at the end of each round of play redistributes lost poker wagers attributable to suboptimal play to other players, rather than to the house. Accordingly, such a wagering game may be particularly attractive to players who perceive themselves as being highly skilled in the wagering game and, therefore, more able to take advantage of suboptimal play by other players.

In some embodiments, a portion of the poker pot may be awarded to at least one player at the end of each round of play (operation 716). For example, the house may take a rake on the poker wager (operation 706), which may still enable the wagering game to qualify as a legal form of online gambling under relevant statutes. The rake taken may comprise, for example, between 1% and 8%, between 2% and 6%, or between 3% and 5% of the first wager. The rake amounts on each wager may be more than, less than, or equal to the rake taken on other wagers in some embodiments.

Figure 18:
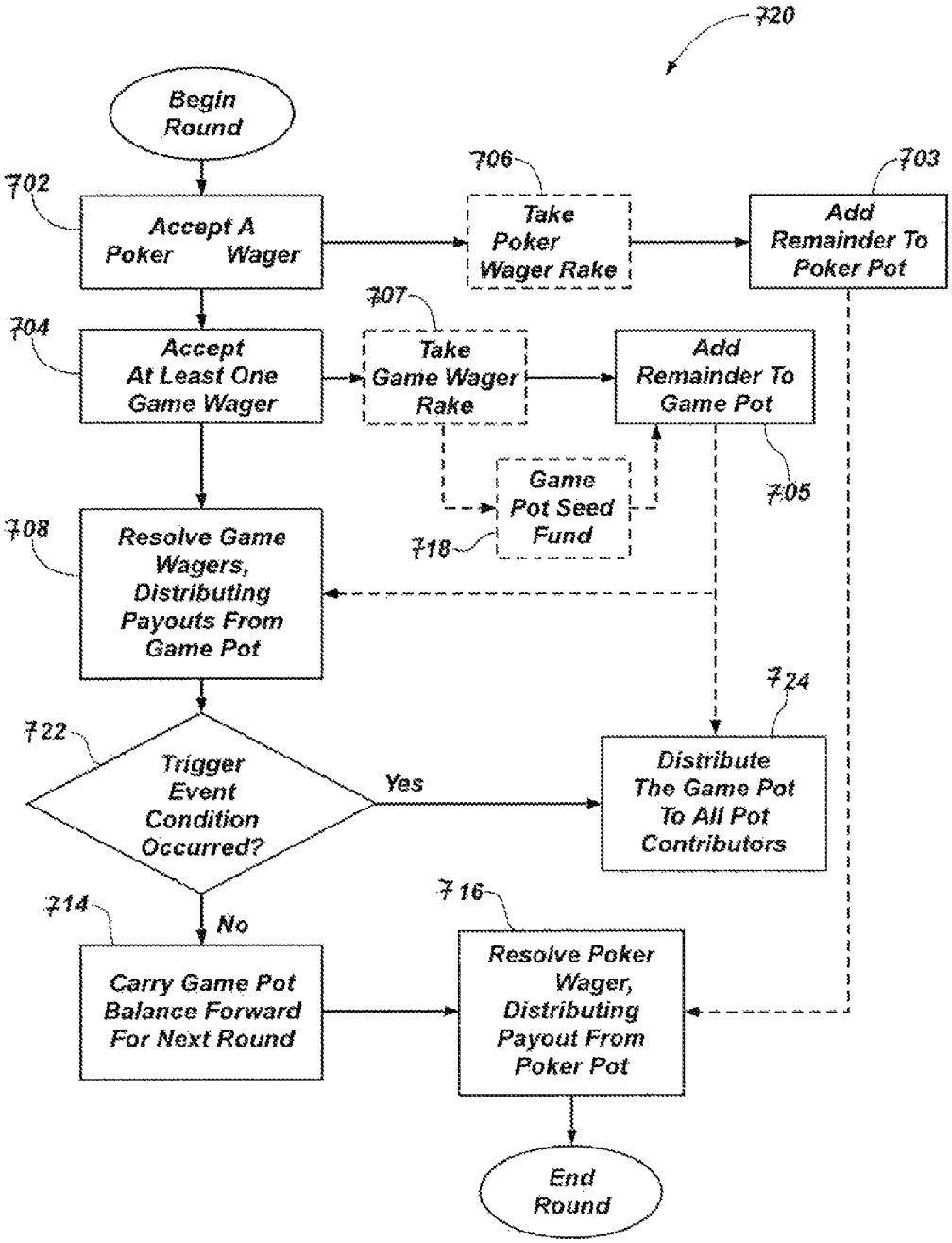
FIG. 18 is a flowchart diagram of a method of administering a wagering game, which may also be at least partially player-pooled, according to a dividend refund embodiment.

In still other embodiments, a portion of the poker pot may remain in the poker pot or may be redistributed to another pot (e.g., the game pot) to be awarded in a subsequent round of play as a progressive payout or as a dividend refund (see FIG. 18). In such an example, the portion of the poker wager remaining in the poker pot or redistributed to another pot may comprise, for example, a fixed percentage of the poker wager, a variable percentage of the poker wager (e.g., an odds payout may be awarded and the remainder retained in the poker pot or redistributed to the other pot), or a fixed amount.

In some embodiments involving a no-house-advantage poker pot awarded at the end of each round and a progressive game pot that receives all other game wagers, all players participating in the wagering game from whom the at least one game wager has been received may be eligible to win the game pot or a portion of the game pot. Players who are ineligible to win the poker pot, and players from whom fold indications have been received but from whom one or more other active wagers in play have been received, may be eligible to win the game pot or a portion of the game pot.

In some embodiments, the game pot may be seeded with money from the game pot rake account or a reserve account (as indicated at operation 718) at the beginning of play, after the game pot or a portion of the game pot has been awarded, or both. In some embodiments, a minimum account balance sufficient to cover expected losses is retained when distributing a progressive payout (operation 712) such that no seed money is required in the game pot. For example, the game pot may be seeded from the rake account of the house (operation 718), and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game, and specifically to place a game wager (e.g., a progressive wager) to be eligible for the progressive payout from the game pot. In addition, such seeding may reduce the likelihood that the amount of funds in the game pot may be insufficient to cover all the payouts to players. For example, where a player hand achieves a premium winning hand composition in one round of play, a player hand achieves a predetermined winning hand combination in the immediately following round of play, and a fixed-odds payout is to be awarded to the player holding the predetermined winning hand combination, the amount seeded to the game pot between those rounds of play may be at least as great as the maximum fixed-odds payout awardable for any predetermined winning hand combination. The game pot may be seeded each time the game pot is awarded in its entirety or each time the amount in the game pot is lower than the maximum fixed-odds payout.

As a specific, nonlimiting example, a player-pooled wagering game with a player-pooled progressive configuration may comprise accepting a poker wager, the ante bet, and the bonus bet from the player at the initiation of the round of the wagering game. The poker wager may be raked and added to a poker pot. The ante bet and the bonus bet may be raked and added to a game pot. The game may be further administered as described with respect to FIGS. 1 through 9B, above, with at least one draw bet event administered. Any received draw bets are raked and added to the game pot. In resolving the ante bet, the bonus bet, and the draw bets, losses are retained in the game pot and payouts are paid from the game pot. Further, it is determined whether a progressive-winning condition, such as a royal flush in a player hand, has occurred during the round of the wagering game. If so, a progressive payout is awarded from the game pot. If not, the remaining amounts in the game pot are carried over for the next around. Before concluding the round, however, the poker pot is distributed to the player or players holding the highest-ranked hand(s) of all the players participating in the round of the wagering game.

Referring to FIG. 18, shown is a flowchart diagram of a method 720 of administering a wagering game, which may be at least partially player-pooled, according to a dividend refund embodiment. The method 720 is largely the same as the method 700 of the player-pooled progressive (FIG. 17), with the exception that, rather than determining whether a progressive-winning condition has occurred (operation 710 (FIG. 17)), the method 720 includes determining whether a trigger event condition has occurred, as indicated at operation 722, and, if so, distributing the game pot to one or more past or present players of the wagering game, as indicated at operation 724 (rather than distributing the game pot as a progressive payout as at operation 712 (FIG. 17)). In such embodiment, the game pot may accumulate between rounds of play, and, to periodically reduce the balance, a dividend (e.g., a share of the game pot awarded to each participating player) may be awarded to players from the game pot. Thus, what would otherwise be the profits from lost wagers, less amounts raked by the house, are redistributed back to the players, rather than collected by the house as revenue. Thus, the distribution is not a payout on the underlying game, but a refund.

The game pot may be distributed among a plurality of players upon the occurrence of a predetermined event (referred to herein as a "trigger event"), as indicated at operation 722. The predetermined, trigger event may not be based, for example, on player skill or chance events occurring in the underlying wagering game. The predetermined trigger event may comprise, for example, determination that at least one player participated for a predetermined number of hands; completed a predetermined number of rounds of play at a given table, electronic gaming machine, or remote gaming device; reached a predetermined time limit since play commenced; or reached a predetermined amount within the game pot. The predetermined trigger event or condition may be time-based, pot-based (or pool-based), game-based, or other-based. Further details on pot distributions based on predetermined trigger events and conditions are disclosed in the U.S. patent application Ser. No. 13/871,824, filed Apr. 26, 2013, titled "Distributing Supplemental Pot in Wagering Games Based on Predetermined Event," the disclosure of which is incorporated herein in its entirety by this reference.

The dividend distributions may be divided at least among players currently participating in the wagering game. In some embodiments, the dividend distributions may also be paid to players who previously contributed to the game pot but who have since ceased participating in the wagering game. In some embodiments, the dividend distributions may not be paid to players from whom contributions to the game pot have not been received since the last dividend distribution was paid. The percentage of the game pot refunded to each player as a dividend distribution may be, for example, approximately equal to the percentage of hands won by each player, the percentage of first pot winnings won by each player based on game play, the percentage of total wager amounts received from each player, the proportional number of wagers received from each player, the proportional length of time spent playing the wagering game by each player, or an equal percentage for each player eligible to receive a dividend distribution from the game pot.

The dividend refund may be distributed in the form of a credit made to the receiving players' accounts. In some embodiments, the refund may be paid without concurrently alerting the player, though the refund may be noticeable when and if the player next checks his or her balance in her player account.

As another specific, nonlimiting example, a player-pooled wagering game with a dividend refund configuration may comprise accepting a poker wager, the ante bet, and the bonus bet from the player at the initiation of the round of the wagering game. The poker wager may be raked and added to a poker pot. The ante bet and the bonus bet may be raked and added to a game pot. The game may be further administered as described with respect to FIGS. 1 through 9B, above, with at least one draw bet event administered. Any received draw bets are raked and added to the game pot. In resolving the ante bet, the bonus bet, and the draw bets, losses are retained in the game pot and payouts are paid from the game pot. Further, it is determined whether a trigger-event condition, such as the game pot reaching a predetermined balance amount, has occurred. If so, a dividend, from the poker pot, is paid to players, past or present, in a predetermined manner, e.g., pro-rata based on amounts contributed to the game pot. If not, the remaining amounts in the game pot are carried over. Before concluding the round, however, the poker pot is distributed to the player or players holding the highest-ranked hand(s) of all the players participating in the round of the wagering game.

In some embodiments, wagering games may be administered over a network without players risking money in connection with the wagers (i.e., "play-for-fun" games). Access to play-for-fun wagering games may be granted on a time period basis in some embodiments. For example, upon initially joining the wagering game, each player may automatically be given wagering elements, such as, for example, chips, points, or simulated currency, that is of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time another quantity of the wagering elements may be distributed to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., the ante bet, the bonus bet, and the draw bets) of no real-world monetary value, and payouts (e.g., payouts on the ante bet, the bonus bet, and the draw bets) may be paid without transferring real-world monetary value to the players. Such embodiments, referred to herein as "free play-for-fun" embodiments are nonetheless contemplated as modes of carrying out the methods described herein.

Other Embodiments

Regardless of the game format used to deliver the game, whether the game is delivered in a live table game format, as a hybrid game, as a multi-player electronic game, as a game administered over a network such as an online wagering game, play for fun game or social game, the game can be offered in different formats.

For example, the game can be a 3, 4, 6, 7 or 8 card poker game. When the game is a three card game, the player makes and ante and bonus bet, and the dealer deals the player an initial hand of three cards. The dealer then receives an election from the player to fold or make a first draw wager. If the player folds, the player loses the ante and bonus wagers. When the player elects to make a first draw wager, the player may discard zero to two cards and receive replacement cards. In a second election step, the player can fold, losing the ante, bonus and first draw wager, or make a second draw wager. When the second draw wager is received, the player can discard zero to one card and receive a replacement card. Although the embodiment above allows the player to replace fewer than all cards in the initial hand, in some forms of the invention, the entire initial hand can be replaced in response to the dealer receiving a first draw wager.

In the embodiments described above, upon receipt of the second draw wager, the player can discard a number of cards fewer than the first number of allowed discarded cards. In the five card example, the player may only discard a maximum of one card in the second draw, and a maximum of three cards in the first draw. In the three card embodiment, the player can discard up to one card in the second draw, and a maximum of three cards in the first draw. The present invention contemplates allowing the player to discard and draw more or fewer cards in the first draw event, and allows the player to discard and draw more or fewer cards in the second event. For example, in a 5 card game, the player may be permitted to discard and draw up to two cards in the first draw event and up to three cards in the second draw event.

When the number of cards in the final hand is other than 5, different bonus pay tables are needed to correspond to the hierarchy of poker hands that corresponds to the number of cards in the hand. For example, the hierarchy of three card poker rankings is different from five card poker rankings.

In some embodiments of the invention, the player cannot elect to continue play without taking at least one draw card. In the described embodiments, the player can place a draw wager without discarding and drawing a card.

In other embodiments, the bonus wager is an optional wager. In the fully described embodiments, the bonus wager is mandatory. Although in some forms of the invention the deck of cards is a standard 52-card deck with two semi-wild jokers, in other forms of the invention, no jokers are added, two or more standard decks of cards are intermixed, and special decks of cards are used, such as a Spanish 21™ deck or a Canasta deck. Some special decks have additional cards such as a fifth suit of cards, or special bonus cards, while other special decks have certain cards removed, such as all 10 value cards, for example.

In a six card version of the game, the dealer may allow the player to discard up to four cards upon receipt of a first draw wager, and may allow the player to discard up to another two cards upon receipt of a second draw wager. The winning hands may include combinations not possible with five card hands, such as two three-of-a-kind's, three pairs, six card flushes, straights, and royal flushes.

In yet other versions of the game, the player may initially receive more cards than is necessary to make a best hand. For example, the player may receive six cards to make a best five-card hand, or may receive four cards to make a best three-card hand. The specific payout odds would need to be adjusted to compensate for the ability of the player to make a better hand with one or more extra cards.

In other embodiments, the player may receive a partial hand of cards, be given the opportunity to better the hand with two discard and draw opportunities, and then be dealt the rest of the hand to complete the hand. For example, the player may receive an initial five card hand, be given the opportunity to discard up to three cards, then one card, and then receive another card to make a total of six cards. In one example of the game, the player makes a best five card hand from the six cards. In another form of the game, the player makes a best six card hand.

In some embodiments of the game, the player is given more than two opportunities to place a draw wager and then discard cards and receive draw cards. In an embodiment, the player makes and ante and bonus wager and receives five cards. The player can elect to fold or make a first draw wager, which qualifies the player to discard and draw up to three additional cards. The player may then elect to fold or make a second draw wager, qualifying the player to discard and draw up to two additional cards. The player may then elect to fold or make a third draw wager, qualifying the player to discard and draw up to one additional card. As the number of draw opportunities and the number of replacement cards grows, the stronger the hand can possibly be. For this reason, the house may wish to adjust the odds payouts on the winning hands, to maintain the desired house advantage on the game.

Additional wagers may be added to the game, such as providing the player with an opportunity to participate in an optional wager to participate in a side bet game with a progressive payout, a higher odds payout, a fixed payout, bad beat payouts and the like.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

As a specific, nonlimiting example, a free play-for-fun wagering game may comprise receiving the ante bet, the bonus bet, the first draw bet, and the second draw bet in the form of credits, tokens, or other wagering elements holding no real-world monetary value and issuing payouts in the form of credits, tokens, or other wagering elements holding no real-world monetary value.

As another specific, nonlimiting example, a social play-for-fun wagering game may comprise allocating to a user (or user device) access tokens having no real-world monetary value. The access tokens are then used for the ante bet, the bonus bet, and the draw bets, and additional access tokens, still with no real-world monetary value, used for payouts on the ante bet, the bonus bet, and the draw bets. The access tokens may be purchased using real-world money, but the access tokens themselves are not redeemable for real-world monetary value.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventor.

What is claimed is:

1. A method for administering a wagering game implemented on an interactive gaming system, comprising:

providing an interactive gaming system comprising a table attended by a live dealer and a video feed of the table and the live dealer communicated to a user device via a table manager programmed to relay instructions, received from the user device, to the live dealer;

providing at or proximate to the table a standard 52-card deck of physical playing cards and further providing at or proximate to the table two physical joker cards randomized with the standard 52-card deck of physical playing cards to form a 54-card deck of physical playing cards, receiving, from the user device via the table manager, an ante bet instruction for an ante bet of an ante bet amount;

receiving, from the user device via the table manager, a bonus bet instruction for a bonus bet of a bonus bet amount;

causing the table manager to communicate, to the user device, video of the live dealer distributing, on a surface of the table and from the 54-card deck of physical playing cards, an initial five physical playing cards for a player hand associated with a user of the user device;

after communicating, to the user device, video of the live dealer distributing the initial five physical playing cards, receiving, from the user device via the table manager, an election instruction selected, by the user of the user device, between a fold instruction, and a first draw bet instruction for a first draw bet of a first draw bet amount;

after receiving, from the user device via the table manager, the first draw bet instruction when the first draw bet instruction is selected between the fold instruction and the first draw bet instruction:

receiving, from the user device via the table manager, a first draw number of cards selected from the initial five physical playing cards, the first draw number which is selected by the user being limited to a maximum of three of the five physical playing cards;

causing the table manager to communicate, to the user device, video of the live dealer distributing, on the surface of the table and from the 54-card deck of physical playing cards, a number of additional cards equaling the first draw number to form an interim five card hand;

receiving, from the user device via the table manager, another election instruction selected, by the user of the user device, between another fold instruction, and a second draw bet instruction for a second draw bet of a second draw bet amount;

after receiving, from the user device via the table manager, the second draw bet instruction when the second draw bet instruction is selected between the another fold instruction and the second draw bet instruction:

receiving, from the user device via the table manager, a second draw number of cards selected from the interim five card hand, the second draw number which is selected by the user being limited to a maximum of one of the cards of the interim five card hand; and causing the table manager to communicate, to the user device, video of the live dealer distributing, on the surface of the table and from the 54-card deck of physical playing cards, a number of final cards equaling the second draw number to form a final five card hand;

resolving the ante bet and all received draw bets of the first draw bet and the second draw bet according to a first payout table; and resolving the bonus bet according to a second payout table.

2. The method of claim 1, wherein resolving the ante bet and all received draw bets and resolving the bonus bet comprise valuing any of the two physical joker cards in the final five card hand as only one of an ace, a fill-in card for a straight, and a fill-in card for a flush.

3. The method of claim 1, wherein receiving, from the user device via the table manager, a bonus bet instruction comprises receiving, from the user device via the table manager, the bonus bet instruction for the bonus bet of a bonus bet amount limited to be equal to the ante bet amount.

4. The method of claim 1, wherein receiving, from the user device via the table manager, an election instruction comprises receiving, from the user device via the table manager, the election instruction selected, by the user of the user device, between the fold instruction and the first draw bet instruction for the first draw bet of a first draw bet amount limited to equal the ante bet amount.

5. The method of claim 1, wherein receiving, from the user device via the table manager, another election instruction comprises receiving, from the user device via the table manager, the another election instruction selected, by the user of the user device, between the another fold instruction and the second draw bet instruction for the second draw bet of a second draw bet amount limited to equal the ante bet amount.

6. The method of claim 1, further comprising causing the table manager to communicate, to the user device, audio of the live dealer.

7. The method of claim 1, wherein providing an interactive gaming system comprises providing the interactive gaming system comprising the table and the video feed communicated via the table manager, the table manager programmed to relay the instructions received from the user device to the live dealer via a dealer display supported by the table.

* * * * *